US009916971B2

(12) United States Patent
Badiei et al.

(10) Patent No.: US 9,916,971 B2
(45) Date of Patent: Mar. 13, 2018

(54) SYSTEMS AND METHODS OF SUPPRESSING UNWANTED IONS

(71) Applicant: PERKINELMER HEALTH SCIENCES, INC., Waltham, MA (US)

(72) Inventors: Hamid Badiei, Woodbridge (CA); Samad Bazargan, Brampton (CA)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

(21) Appl. No.: 15/444,792

(22) Filed: Feb. 28, 2017

(65) Prior Publication Data

US 2017/0301528 A1 Oct. 19, 2017

Related U.S. Application Data

(63) Continuation of application No. 14/941,748, filed on Nov. 16, 2015, now Pat. No. 9,589,780, which is a continuation of application No. 14/531,661, filed on Nov. 3, 2014, now Pat. No. 9,190,253, which is a continuation-in-part of application No. 13/854,458, filed on Apr. 1, 2013, now Pat. No. 8,884,217, which is a continuation of application No. 13/277,594, filed on Oct. 20, 2011, now Pat. No. 8,426,804, which is a (Continued)

(51) Int. Cl.

| | |
|---|---|
| ***H01J 49/00*** | (2006.01) |
| ***H01J 49/06*** | (2006.01) |
| ***H01J 49/10*** | (2006.01) |
| ***H01J 49/24*** | (2006.01) |

(52) U.S. Cl.

CPC ..... *H01J 49/061* (2013.01); *H01J 49/00* (2013.01); *H01J 49/005* (2013.01); *H01J 49/0031* (2013.01); *H01J 49/0045* (2013.01); *H01J 49/0077* (2013.01); *H01J 49/10* (2013.01); *H01J 49/24* (2013.01); *H01J 49/105* (2013.01)

(58) Field of Classification Search

USPC ..... 250/281–300, 526

See application file for complete search history.

(56) References Cited

U.S. PATENT DOCUMENTS

| | | | |
|---|---|---|---|
| 5,345,079 | A | 9/1994 | French |
| 5,381,008 | A | 1/1995 | Tanner |
| 5,565,679 | A | 10/1996 | Tanner |

(Continued)

FOREIGN PATENT DOCUMENTS

| | | |
|---|---|---|
| WO | 9722233 | 6/1997 |
| WO | 9829896 | 7/1998 |

(Continued)

OTHER PUBLICATIONS

ISR/WO for PCT/US11/26463 dated Jul. 27, 2011.

(Continued)

*Primary Examiner* — Bernard Souw

(74) *Attorney, Agent, or Firm* — Rhodes IP PLC; Christopher R Rhodes

(57) ABSTRACT

Certain embodiments described herein are directed to systems including a cell downstream of a mass analyzer. In some instances, the cell is configured as a reaction cell, a collision cell or a reaction/collision cell. The system can be used to suppress unwanted ions and/or remove interfering ions from a stream comprising a plurality of ions.

11 Claims, 12 Drawing Sheets

Related U.S. Application Data continuation of application No. PCT/US2011/026463, filed on Feb. 28, 2011.

(60) Provisional application No. 61/308,676, filed on Feb. 26, 2010.

(56) References Cited

U.S. PATENT DOCUMENTS

| | | | | |
|---|---|---|---|---|
| 5,652,247 | A | 7/1997 | Whitehouse | |
| 5,684,581 | A | 11/1997 | French | |
| 5,969,352 | A | 10/1999 | French | |
| 6,140,638 | A | 10/2000 | Tanner | |
| 6,297,501 | B1 * | 10/2001 | Merren | H01J 49/30 250/282 |
| 6,627,877 | B1 | 9/2003 | Davis | |
| 6,627,912 | B2 | 9/2003 | Bandura | |
| 6,875,618 | B2 | 4/2005 | Bandura | |
| 6,914,241 | B2 | 7/2005 | Giles | |
| 7,135,296 | B2 | 11/2006 | Baranov | |
| 7,145,137 | B2 | 12/2006 | Montaser | |
| RE39,627 | E | 5/2007 | Tanner | |
| 7,317,186 | B2 | 1/2008 | Montaser | |
| 7,411,192 | B2 * | 8/2008 | Takeuchi | H01J 37/09 250/306 |
| 7,479,630 | B2 | 1/2009 | Bandura | |
| 7,483,767 | B2 | 1/2009 | Montaser | |
| 7,550,740 | B2 * | 6/2009 | Takeuchi | H01J 37/09 250/298 |
| 7,700,295 | B2 | 4/2010 | Baranov | |
| 7,767,407 | B2 | 8/2010 | Baranov | |
| 7,804,064 | B2 | 9/2010 | Montaser | |
| 8,426,804 | B2 | 4/2013 | Badiei | |
| 8,884,217 | B2 | 11/2014 | Badiei | |
| 9,190,253 | B2 * | 11/2015 | Badiei | H01J 49/005 |
| 9,589,780 | B2 * | 3/2017 | Badiei | H01J 49/005 |
| 2003/0001085 | A1 | 1/2003 | Bateman | |
| 2005/0224709 | A1 | 10/2005 | Montaser | |
| 2005/0230617 | A1 | 10/2005 | Montaser | |
| 2006/0022150 | A1 * | 2/2006 | Takeuchi | H01J 37/09 250/492.21 |
| 2006/0087651 | A1 | 4/2006 | Montaser | |
| 2007/0299561 | A1 | 12/2007 | Montaser | |
| 2008/0023641 | A1 * | 1/2008 | Takeuchi | H01J 37/09 250/396 ML |
| 2009/0134326 | A1 | 5/2009 | Bandura | |
| 2009/0179161 | A1 | 7/2009 | Ward | |
| 2011/0210241 | A1 | 9/2011 | Badiei | |
| 2011/0253888 | A1 | 10/2011 | Badiei | |
| 2012/0091331 | A1 | 4/2012 | Badiei | |
| 2013/0284917 | A1 | 10/2013 | Badiei | |
| 2014/0083544 | A1 | 3/2014 | Chan | |
| 2014/0117248 | A1 | 5/2014 | Kahen | |
| 2015/0136966 | A1 * | 5/2015 | Badiei | H01J 49/005 250/281 |
| 2015/0162174 | A1 | 6/2015 | Badiei | |

FOREIGN PATENT DOCUMENTS

| | | |
|---|---|---|
| WO | 02054075 | 7/2002 |
| WO | 03009332 | 1/2003 |
| WO | 2005003767 | 1/2005 |
| WO | 2005093784 | 10/2005 |

OTHER PUBLICATIONS

Bandura et al. Anal. Chem., vol. 81, No. 16, pp. 6813-6822, 2009.
Sturgeon et al. J. Anal. St. Spectrom., 16, pp. 607-616, 2000.
Praphairaksit et al. Anal. Chem. vol. 72, No. 11, Jun. 1, 2000.
Tanner et al. Appl. Spectroscopy, vol. 48, No. 11, 1994.

* cited by examiner

SYSTEMS AND METHODS OF SUPPRESSING UNWANTED IONS

PRIORITY APPLICATION

This application is a continuation-in-part application of U.S. application Ser. No. 13/854,458 filed on Apr. 1, 2013, the entire disclosure of which is hereby incorporated herein by reference for all purposes. U.S. application Ser. No. 13/854,458 was a continuation application of U.S. application Ser. No. 13/277,594 filed on Oct. 20, 2011. U.S. application Ser. No. 13/277,594 claimed priority to PCT/US11/26463 filed on Feb. 28, 2011. PCT/US11/26463 claimed priority to U.S. 61/308,676 filed on Feb. 26, 2010.

TECHNOLOGICAL FIELD

Certain features, aspects and embodiments are directed to systems configured to suppress unwanted or interfering ions. In certain embodiments, the system can include a cell downstream of a mass analyzer.

BACKGROUND

Mass spectrometry separates species based on differences in mass-to-charge ratios. Species having the same mass-to-charge ratios may not be distinguishable from each other in certain instances.

SUMMARY

Certain aspects described herein are directed to systems effective to remove interfering ions having the same mass-to-charge ratio as analyte ions. Various configurations of the systems can include one or more cells downstream of a mass analyzer. In some instances, the system can be effective to remove interfering ions by using only a single mass analyzer.

In one aspect, a system comprising an ion source, ion optics fluidically coupled to the ion source, a mass analyzer fluidically coupled to the ion optics, in which the mass analyzer is the only mass analyzer in the system, a cell fluidically coupled to the mass analyzer and downstream of the mass analyzer, and a detector fluidically coupled to the cell is provided.

In certain configurations, the cell is configured as a reaction cell, a collision cell or a reaction/collision cell. In other configurations, the cell comprises a plurality of electrodes. In some instances, the plurality of electrodes are configured together to provide a quadrupolar field in the cell. In some embodiments, each of the plurality of electrodes is configured as a rod. In other examples, the system can include an interface between the ion source and the ion optics. In certain examples, the ion source is selected from the group consisting of an inductively coupled plasma, an arc, a spark, a glow discharge and a flame. In other examples, the ion source is an ion source with a temperature less than a temperature of an inductively coupled plasma. In some examples, the mass analyzer is selected from the group consisting of a scanning mass analyzer, a magnetic sector analyzer, a quadrupole mass analyzer, an ion trap analyzer, and a time-of-flight analyzer. In other embodiments, the detector is selected from the group consisting of a Faraday cup, an electron multiplier, and a microchannel plate.

In another aspect, a system comprising an ion source and a mass analyzer is provided. In some configurations, the mass analyzer is fluidically coupled to the ion source and is configured to receive an ion beam from the ion source, the ion beam comprising a plurality of ions with different mass-to-charge ratios, in which the mass analyzer is further configured to select native ions from the ion beam, in which the native ions comprise a single mass-to-charge ratio and comprise analyte ions and interfering ions, in which the mass analyzer is the only mass analyzer present in the system. In some instances, the system further comprises a cell fluidically coupled to the mass analyzer and configured to receive the native ions from the mass analyzer, the cell further configured to remove the altered, interfering ions from the native ions. In other embodiments, the system also includes a detector fluidic ally coupled to the cell and configured to receive the analyte ions from the cell and to detect the received analyte ions.

In certain embodiments, the system further comprises ion optics fluidically coupled to the ion source and the mass analyzer and positioned between the ion source and the mass analyzer. In other embodiments, the cell is configured as a reaction cell, a collision cell or a reaction/collision cell. In some configurations, the cell comprises a plurality of electrodes. In additional examples, the plurality of electrodes are configured together to provide a quadrupolar field in the cell. In some instances, the system further comprises an interface between the ion source and the ion optics. In some examples, the ion source is selected from the group consisting of an inductively coupled plasma, an arc, a spark, a glow discharge and a flame. In certain embodiments, the ion source is an ion source with a temperature less than a temperature of an inductively coupled plasma. In further examples, the mass analyzer is selected from the group consisting of a scanning mass analyzer, a magnetic sector analyzer, a quadrupole mass analyzer, an ion trap analyzer, and a time-of-flight analyzer. In some instances, the detector is selected from the group consisting of a Faraday cup, an electron multiplier, and a microchannel plate.

In an additional aspect, a mass spectrometry system comprising a single mass analyzer is described. In some examples, the system comprises an ion source, ion optics fluidically coupled to the ion source and downstream of the ion source, a single mass analyzer fluidically coupled to the ion optics and downstream of the ion optics so the ion optics are between the ion source and the single mass analyzer, in which the single mass analyzer is the only mass analyzer present in the system, a cell fluidically coupled to the single mass analyzer and downstream of the single mass analyzer so the single mass analyzer is between the cell and the ion optics, and a detector fluidically coupled to the cell and downstream of the cell so the cell is between the single mass analyzer and the detector.

In certain embodiments, the cell is configured as a reaction cell, a collision cell or a reaction/collision cell. In other embodiments, the cell comprises a plurality of electrodes. In additional examples, the plurality of electrodes are configured together to provide a quadrupolar field in the cell. In further embodiments, the system comprises an additional cell upstream of the single mass analyzer, in which the additional cell is between the single mass analyzer and the ion optics. In other examples, the system comprises an interface between the ion source and the ion optics. In some configurations, the ion source is selected from the group consisting of an inductively coupled plasma, an arc, a spark, a glow discharge and a flame. In additional examples, the ion source is an ion source with a temperature less than a temperature of an inductively coupled plasma. In other examples, the mass analyzer is selected from the group consisting of a scanning mass analyzer, a magnetic sector analyzer, a quadrupole mass analyzer, an ion trap analyzer, and a time-of-flight analyzer. In some instances, the detector is selected from the group consisting of a Faraday cup, an electron multiplier, and a microchannel plate.

In another aspect, a method of suppressing interfering species in an ion beam within a mass spectrometer system comprising a mass analyzer, the method comprising providing the ion beam to a cell of the mass spectrometer that is downstream from the mass analyzer to remove the interfering species in the ion beam is disclosed.

In certain embodiments, the method can include configuring the mass analyzer to provide an ion(s) of a single target mass to the cell. In other embodiments, the mass analyzer can be configured with a quadrupole. In further examples, the mass analyzer is the only mass analyzer in the system. In some examples, the method can include positioning a second cell downstream of the cell. In other embodiments, the method can include configuring the cell to remove substantially all polyatomic species in a first ion beam provided from the mass analyzer to the cell before providing a second ion beam from the cell to a downstream detector. In some embodiments, the method can include configuring the cell as a reaction cell, a collision cell or a reaction/collision cell. In additional embodiments, the method can include configuring the system with an additional cell upstream of the mass analyzer. In some configurations, the method can include configuring the upstream, additional cell as a reaction cell, a collision cell or a reaction/collision cell. In other examples, the method can include configuring the cell to provide a quadrupolar field effective to remove the interfering species in the ion beam.

In an additional aspect, a method comprising selecting native ions comprising a single mass-to-charge ratio from an ion beam comprising a plurality of ions with different mass-to-charge ratios, and providing the selected, native ions to a downstream cell is provided.

In certain examples, the method comprises selecting the native ions using a mass analyzer. In other examples, the method comprises configuring the cell to remove interfering ions in the native ions. In certain embodiments, the method comprises configuring the cell as a reaction cell. In some examples, the method comprises configuring the cell as a collision cell. In certain configurations, the method comprises configuring the cell to operate in both a collision mode and a reaction mode. In other examples, the method comprises configuring the system with an additional cell upstream of the downstream cell. In some examples, the method comprises configuring the system with an ion source, a mass analyzer and a detector, in which the ion source is upstream of the mass analyzer, the mass analyzer is upstream of the downstream cell and between the ion source and the downstream cell and in which the detector is downstream of the downstream cell. In additional examples, the method comprises reacting the selected, native ions with a reactant gas effective to react with interfering ions in the selected, native ions. In some embodiments, the method comprises colliding the selected, native ions with a collision gas effective to alter interfering ions in the selected, native ions.

Additional attributes, features, aspects, embodiments and configurations are described in more detail herein.

BRIEF DESCRIPTION OF THE FIGURES

Certain features, aspects and embodiments of the systems are described with reference to the accompanying figures, in which.

Figure 1:
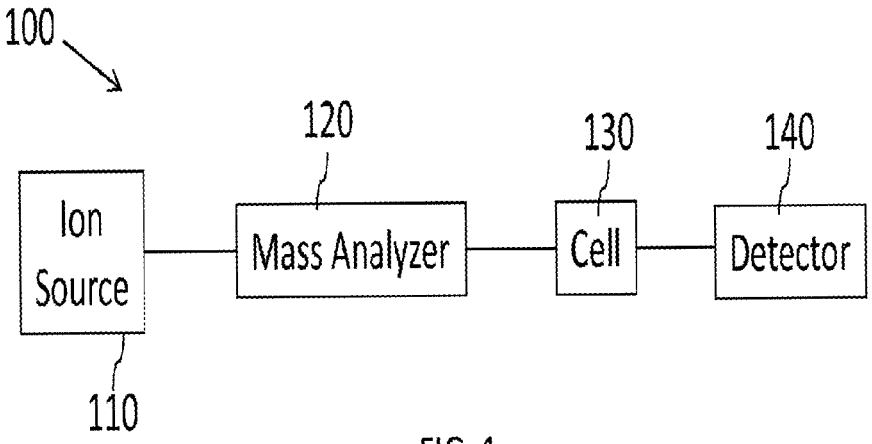
FIG. 1 is a block diagram of a system comprising a cell downstream of a mass analyzer, in accordance with certain configurations.

It will be recognized by the person of ordinary skill in the art, given the benefit of this disclosure, that the components in the figures are not limiting and that additional components may also be included without departing from the spirit and scope of the technology described herein.

DETAILED DESCRIPTION

Certain features, aspects and embodiments described herein are directed to systems that are configured to suppress unwanted or interfering ions in an ion beam. The terms "upstream" and "downstream" generally refers to the direction of ion flow in the system. For example, a downstream component receives ions from an upstream component.

In conventional mass spectrometers, the mass analyzer is located downstream of the cell. Spectral interferences created in the cell can limit the detection limits achievable. For example, in a conventional system all ions first enter a pressurized cell. The ions can include matrix or interfering species that overlap with a particular analyte of interest. In addition, where the cell produces product ions, many of the product ions may be interfering ions. Both the desired ion(s) and the interfering ions would be provided to a downstream mass analyzer. Because the interfering ions and the ion of interest have the same mass-to-charge, both ions will be detected, which leads to inaccurate and imprecise measurements.

In certain configurations described herein, the cell is positioned downstream from a mass analyzer such that species in an ion beam are first selected by the mass analyzer prior to being provided to the cell. By first introducing ions into a mass analyzer prior to introduction into a cell, substantially more matrix interferences can be removed. For example, as described in more detail herein, when a sample stream comprising an ion of interest and interfering species are first introduced into a cell and then into a mass analyzer, the resulting output from the mass analyzer often includes the ion of interest and interfering ions. The stream outputted from the system to the detector will include the interfering ions, which will provide inaccurate measurements by the detector. When the same sample stream comprising the ion of interest and interfering species are first introduced into a mass analyzer and then to a cell, the particular ion of interest can be selected and outputted from the cell without any of the interfering species present in the output stream. The output in this second configuration permits more accurate and precise measurements since only the ion(s) of interest are provided to the detector. In some instances, native ions (or ions comprising analyte ions) with a single mass-to-charge ratio can be selected by the mass analyzer and all other ions are rejected. The term "native ions(s)" as used herein refers to ions from an ion source that have not been subjected to reaction with a reaction gas or collision with a collision gas. The native ions are typically generated using an ionization source, e.g., plasma, flame, arc, spark, glow discharge or the like. Native ions from the ion source generally include a plurality of ions with different mass-to-charge ratios and can include analyte ions and interfering ions. In some configurations, only a single mass analyzer is present in the systems described herein.

In certain configurations, the positioning of the cell and mass analyzer described herein permits ion selection similar to that which can be obtained using conventional triple quad devices but at a lower cost, a simpler design and with an overall smaller footprint. For example, the simpler design of using a cell with a quadrupolar field positioned downstream of a mass analyzer (as compared to the design of a triple quad) avoids the need to synchronize electrical parameters as needed in a triple quad design and reduces the amount of infrastructure needed to drive the second mass analyzer. Using such configurations, a single mass-to-charge ratio, containing the analyte of interest, is admitted to the cell from the upstream mass analyzer similar to the operation of a triple quad device. Subsequently, interference removal is performed in either a reaction or collision mode of the cell. One attribute of the disclosed configurations desirably utilizes the ability of the cell to reject unwanted species (e.g., new product species formed in the cell, or species that did not undergo reaction) in-situ using its quadrupolar field and by setting the appropriate RF and DC voltages for a given mass. This configuration can eliminate the need for a second mass analyzer downstream of the cell since the cell itself can provide a band pass tuning with a resolution that is adequate to separate the analyte of interest from other interfering species. Further, the use of a cell, with a quadrupolar field and an axial field, positioned downstream from a mass analyzer permits measurement of fast transient signals, e.g., a cell comprising axial electrodes permits capturing of very fast transients as the measurements are not slowed by operation of the triple quad. The mass analyzer/cell positioning also permits omission of a second mass analyzer in the system, which further reduces cost and complexity of operation. Additional attributes of systems where a cell is positioned downstream from a mass analyzer are described in more detail below.

In certain instances and referring to FIG. 1, a block diagram of one system is shown. The system 100 comprises an ion source 110 fluidically coupled to a mass analyzer 120. The mass analyzer 120 is downstream of the ion source 110, e.g., ions flow from the ion source 110 to the mass analyzer 120. The mass analyzer 120 is fluidically coupled to a cell 130. The cell 130 is downstream of the mass analyzer 120 and receives ions selected by the mass analyzer 120. As noted herein, by positioning the cell 130 downstream of the mass analyzer, it is possible to select only a single ion of interest from a sample comprising the ion of interest and interfering species. The cell 130 is fluidically coupled to a detector 140, which is positioned downstream of the cell 130. In some configurations, the mass analyzer 120 may be the only mass analyzer present in the system 100. As discussed in more detail below, the cell 130 may be a reaction cell, a collision cell, a reaction/collision cell or other suitable cells.

Figure 2:
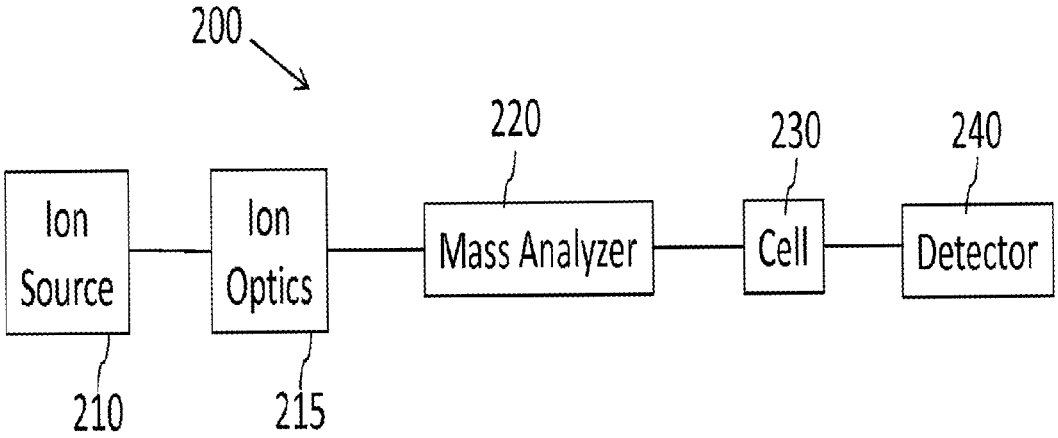
FIG. 2 is a block diagram of another system comprising a cell downstream of a mass analyzer, in accordance with certain configurations.

Another block diagram of a second system is shown in FIG. 2. The system 200 comprises an ion source 210 fluidically coupled to ion optics 215. The ion optics 215 are fluidically coupled to a mass analyzer 220. The mass analyzer 220 is downstream of the ion optics 215, e.g., ions flow from the ion optics 215 to the mass analyzer 220. The mass analyzer 220 is fluidically coupled to a cell 230. The cell 230 is downstream of the mass analyzer 220 and receives ions selected by the mass analyzer 220. For example, the mass analyzer can be used to select species with a selected mass-to-charge ratio. These ions are provided to the cell, which can be used to remove any interfering species so the cell output comprises substantially only the ion of interest, which may be present in a native form or as a reaction product, e.g., as a reaction product with a reaction gas such as oxygen or ammonia. The cell 230 is fluidically coupled to a detector 240, which is positioned downstream of the cell 230. In some instances, the mass analyzer 220 may be the only mass analyzer present in the system 200. As discussed in more detail below, the cell 230 may be a reaction cell, a collision cell, a reaction/collision cell or other suitable cells. In certain configurations, the ion optics present in the systems described herein, as noted in connection with FIG. 7 below, can be configured to focus the ions from the ion source into an ion beam that is provided to the mass analyzer or other downstream component. The exact configuration of the ion optics can vary and may include ion lenses, charged plates or other suitable components. The ion optics are generally maintained at a low pressure using a suitable pump or pumps, e.g., a turbomolecular pump.

Figure 3:
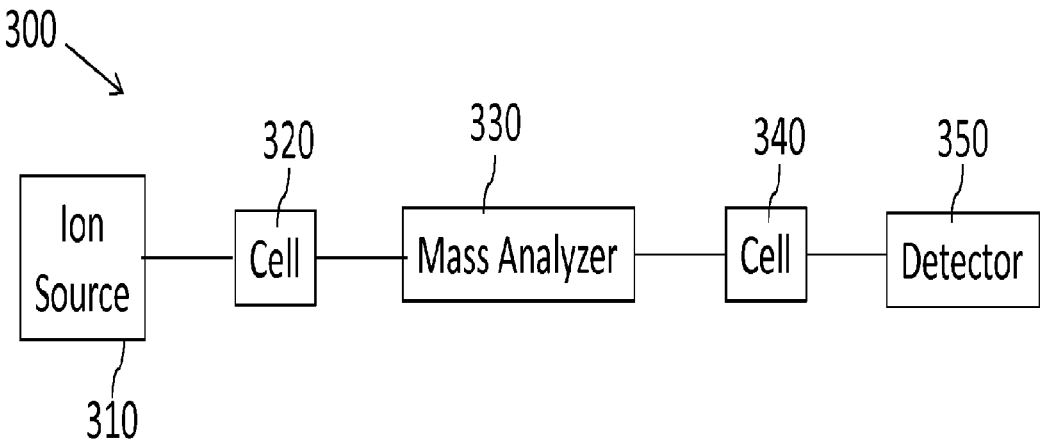
FIG. 3 is a block diagram of another system comprising a cell downstream of a mass analyzer and a cell upstream of a mass analyzer, in accordance with certain configurations.

A block diagram of another system is shown in FIG. 3. The system 300 comprises an ion source 310 fluidically coupled to a first cell 320. The first cell 320 is fluidically coupled to a mass analyzer 330. The mass analyzer 330 is downstream of the first cell 320, e.g., ions flow from the first cell 320 to the mass analyzer 330. The mass analyzer 330 is fluidically coupled to a second cell 340. The cell 340 is downstream of the mass analyzer 330 and receives ions selected by the mass analyzer 330. The cell 340 is fluidically coupled to a detector 350, which is positioned downstream of the second cell 340. In some configurations, the mass analyzer 330 may be the only mass analyzer present in the system 300. As discussed in more detail below, each of the cells 320, 340 may independently be a reaction cell, a collision cell, a reaction/collision cell or other suitable cells. For example, the cell 320 can be a reaction cell and the cell 340 can be a collision cell. In other instances, the cell 320 can be a collision cell and the cell 340 can be a reaction cell. In different configurations, the cell 320 and the cell 340 may both be reaction cells, and the same or different reaction gases can be introduced into each of the cells 320, 340. In other instances, the cell 320 and the cell 340 can each be a collision cell, and the collision gas introduced into each of the cells 320, 340 may be the same or may be different. In some instances, the cell 320 is a reaction cell, and the cell 340 is a reaction/collision cell. In other instances, the cell 320 is a reaction/collision cell, and the cell 340 is a reaction cell. In other configurations, the cell 320 is a collision cell, and the cell 340 is a reaction/collision cell. In further instances, the cell 320 is a reaction/collision cell, and the cell 340 is a collision cell. In certain examples, each of the cells 320, 340 may be a reaction/collision cell, and the cells 320, 340 may be operated in the same mode or in different modes depending on the desired system configuration and use. If desired, ion optics (not shown) may be present between the ion source 310 and the cell 320. In some configurations, the mass analyzer 330 may be the only mass analyzer present in the system 300. By positioning the mass analyzer upstream of the cells 320, 340, only a single ion of interest (or a reaction product thereof) can be provided to the detector 350. In configurations where both the cells 320, 340 are upstream from the mass analyzer 330, interfering species may not be removed effectively prior to introduction to the detector 350.

Figure 4:
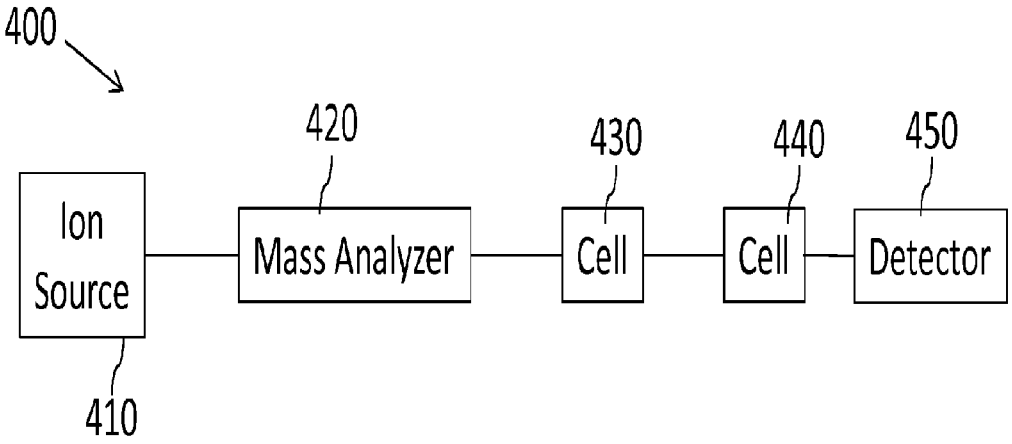
FIG. 4 is a block diagram of another system comprising two cells downstream of a mass analyzer, in accordance with certain configurations.

Referring to FIG. 4, a block diagram of another system is shown. The system 400 comprises an ion source 410 fluidically coupled to a mass analyzer 420. The mass analyzer 420 is fluidically coupled to a first cell 430. The first cell 430 is downstream of the mass analyzer 420, e.g., ions flow from the mass analyzer 420 to the first cell 430. The first cell 430 is fluidically coupled to a second cell 440. The cell 440 is downstream of the cell 430 and receives ions from the cell 430. The cell 430 is fluidically coupled to a detector 450, which is positioned downstream of the cell 440. In some configurations, the mass analyzer 420 may be the only mass analyzer present in the system 400. As discussed in more detail below, each of the cells 430, 440 may independently be a reaction cell, a collision cell, a reaction/collision cell or other suitable cells. For example, the cell 430 can be a reaction cell and the cell 440 can be a collision cell. In other instances, the cell 430 can be a collision cell and the cell 440 can be a reaction cell. In different configurations, the cell 430 and the cell 440 may both be reaction cells, and the same or different reaction gases can be introduced into each of the cells 430, 440. In other instances, the cell 430 and the cell 440 can each be a collision cell, and the collision gas introduced into each of the cells 430, 440 may be the same or may be different. In some instances, the cell 430 is a reaction cell, and the cell 440 is a reaction/collision cell. In other instances, the cell 430 is a reaction/collision cell, and the cell 440 is a reaction cell. In other configurations, the cell 430 is a collision cell, and the cell 430 is a reaction/collision cell. In further instances, the cell 430 is a reaction/collision cell, and the cell 440 is a collision cell. In certain examples, each of the cells 430, 440 may be a reaction/collision cell, and the cells 430, 440 may be operated in the same mode or in different modes depending on the desired system configuration and use. If desired, ion optics (not shown) may be present between the ion source 410 and the mass analyzer 420. By positioning both cells 430, 440 downstream of the mass analyzer 420, it may be easier to remove interfering species from a sample comprising one or more ions of interest and interfering species, e.g., those having the same mass-to-charge ratio as the ion of interest.

Figure 5:
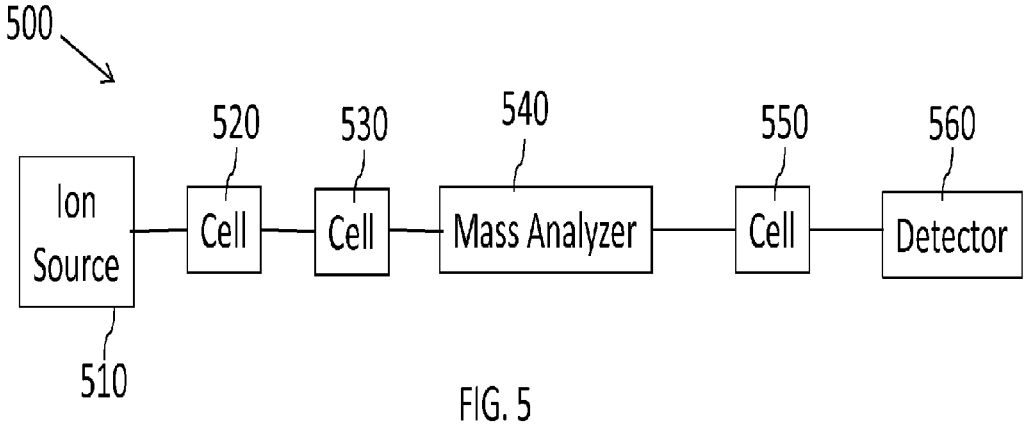
FIG. 5 is a schematic of a system comprising two cells upstream of a mass analyzer and a cell downstream of the mass analyzer, in accordance with certain configurations.

In certain configurations, the systems described herein may comprise an odd number of cells with more cells upstream or downstream of a mass analyzer. Referring to FIG. 5, a block diagram of a system 500 with two cells upstream of a mass analyzer and one cell downstream of a mass analyzer is shown. The system 500 comprises an ion source 510 fluidically coupled to a first cell 520. The first cell 520 is fluidically coupled to a second cell 530. The second cell 530 is downstream of the first cell 520. The second cell 530 is fluidically coupled to a mass analyzer 540. A third cell 550 is fluidically coupled to the mass analyzer 540 and downstream of the mass analyzer 540. The cell 550 is fluidically coupled to a detector 560, which is positioned downstream of the cell 550. In some configurations, the mass analyzer 540 may be the only mass analyzer present in the system 500. As discussed in more detail below, each of the cells 520, 530 and 550 may independently be a reaction cell, a collision cell, a reaction/collision cell or other suitable cells. If desired, ion optics (not shown) may be present between the ion source 510 and the cell 520.

Figure 6:
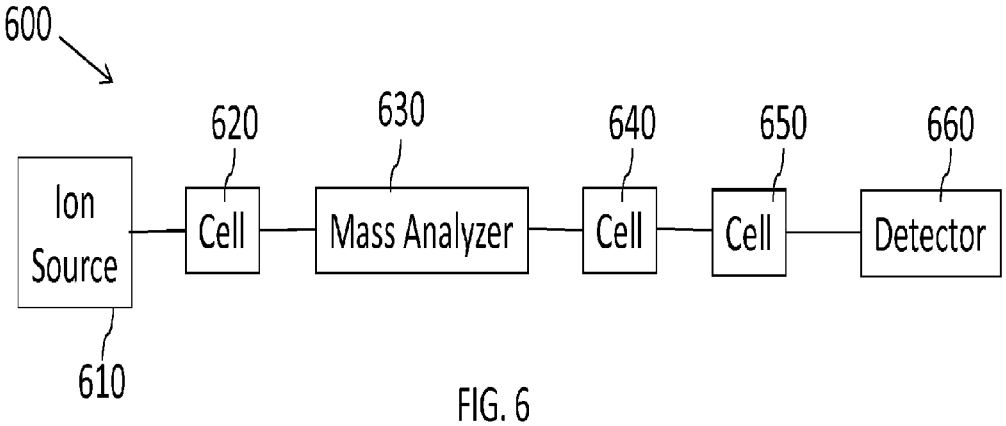
FIG. 6 is a schematic of a system comprising a cell upstream of a mass analyzer and two cells downstream of the mass analyzer, in accordance with certain configurations.

Another configuration of a system with an odd number of cells is shown in FIG. 6. The system 600 comprises an ion source 610 fluidically coupled to a first cell 620. The first cell 620 is fluidically coupled to a mass analyzer 630. The mass analyzer 630 is fluidically coupled to a second cell 640 downstream of the mass analyzer 630. A third cell 650 is fluidically coupled to the second cell 640. The cell 650 is fluidically coupled to a detector 660, which is positioned downstream of the cell 650. In some configurations, the mass analyzer 630 may be the only mass analyzer present in the system 600. As discussed in more detail below, each of the cells 620, 640 and 650 may independently be a reaction cell, a collision cell, a reaction/collision cell or other suitable cells. If desired, ion optics (not shown) may be present between the ion source 610 and the cell 620. While not shown, all three cells, 620, 640 and 650 can be positioned downstream of the mass analyzer 620, if desired.

In certain configurations, the ion sources of the systems described herein may be an arc, spark, flame, inductively coupled plasma, capacitively coupled plasma or other ion sources as discussed in more detail below. Analysis of metals and other inorganic analytes, can be advantageously carried out using an inductively coupled plasma (ICP) ion source due to the relatively high ion sensitivities that can be achieved in ICP-MS. Ion concentrations below one part per billion are achievable with ICP ion sources. In an inductively coupled plasma ion source, the end of a torch consisting of three concentric tubes, typically quartz, can be placed into an induction coil supplied with a radio-frequency electric current. A flow of argon gas can then be introduced between the two outermost tubes of the torch, where the argon atoms can interact with the radio-frequency magnetic field of the induction coil to free electrons from the argon atoms. A very high temperature (perhaps 10,000K or more) plasma can be produced comprising mostly argon atoms with a small fraction of argon ions and free electrons. The analyte sample can then be passed through the argon plasma, for example as an aerosolized or nebulized mist of liquid. Droplets of the nebulized sample can evaporate, with any solids dissolved in the liquid being broken down into atoms and, due to the extremely high temperatures in the plasma, stripped of their most loosely-bound electron to form a singly charged ion. The ion stream generated by an ICP ion source can, in addition to the analyte ions of interest, often contain a large concentration of argon and argon based spectral interference ions. Some of the more common spectral interferences include Ar+, ArO+, Ar2+, ArCl+, ArH+, and MAr+ (where M denotes the matrix metal in which the sample was suspended for ionization), but also may include other spectral interferences such as ClO+, MO+, and the like. It will be appreciated that other types of ion sources, including glow discharge and electrospray ion sources, may also produce non-negligible concentrations of spectral interferences. It will further be appreciated that spectral interferences may be generated from other sources in MS, for example during ion extraction from the source (e.g. due to cooling of the plasma once it is subjected to vacuum pressures outside of the ICP, or perhaps due to interactions with the sampler or skimmer orifices). The momentum boundaries existing at the edges of a sampler or skimmer represent another possible source of spectral interferences.

In other configurations, the cells described herein, e.g., those shown in FIGS. 1-6, may be one or more of a reaction cell, a collision cell or a reaction/collision cell. In instances where the cell takes the form of a reaction cell, also referred to herein as a dynamic reaction cell (DRC), the reaction cell can be configured to provide a reactant gas to react with ions in the cell. For example, one way of mitigating the effects of spectral interferences in the ion stream is to selectively eliminate the interferer ions upstream of the detector stage. The cell can be filled with a selected gas that is reactive with the unwanted interferer ions, while remaining more or less inert toward the analyte ions. As the ion stream collides with the reactive gas in the DRC, the interferer ions can form product ions that no longer have substantially the same or similar m/z ratio as the analyte ions. If the mass-to-charge (m/z) ratio of the product ion substantially differs from that of the analyte ion, then conventional mass filtering can be applied by the cell to eliminate the product interferer ions without significant disruption of the flow of analyte ions. In other words, the ion stream can be subjected to a band pass mass filter to transmit only the analyte ions to the detector stage in significant proportions. Use of a DRC to eliminate interferer ions is described more fully in U.S. Pat. Nos. 6,140,638 and 6,627,912, the entire contents of which are incorporated herein by reference. DRC can provide extremely low detection limits, perhaps even on the order of parts or subparts per trillion depending on the analyte of interest. Different reactive gases can be used for different analytes. In certain instances, radial confinement of ions is provided within the cell by forming a radial RF field within an elongated rod set. Confinement fields of this nature can, in general, be of different orders, but are commonly either a quadrupolar field, or else some higher order field, such as a hexapolar or octopolar field. For example, application of small dc voltages to a quadrupole rod set, in conjunction with the applied quadrupolar RF, can destabilize ions of m/z ratios falling outside of a narrow, tunable range, thereby creating a form of mass filter for ions.

In other instances, the cell may take the form of a collision cell. The collision cell is configured to permit kinetic energy discrimination (KED). For example, the ion stream can be collided inside the collision cell with a substantially inert gas. Both the analyte and interferer ions can be collided with the inert gas causing an average loss of kinetic energy in the ions. The amount of kinetic energy lost due to the collisions can in general be related to the collisional cross-section of the ions, which can be related to the elemental composition of the ion. Polyatomic ions (also known as molecular ions) composed of two or more bonded atoms tend to have a larger collisional cross-section than do monatomic ions, which are composed only of a single charged atom. Consequently, the inert gas can collide preferentially with the polyatomic atoms to cause on average a greater loss of kinetic energy than will be seen in monatomic atoms of the same m/z ratio. A suitable energy barrier established at the downstream end of the collision cell can then trap a significant portion of the polyatomic interferers and prevent transmission to the downstream detector. KED can have the benefit of being generally more versatile and simpler to operate, in so far as the choice of inert gas does not substantially depend on the particular interferer and/or analyte ions of interest. A single inert gas, which is often helium, can be effective to remove many different polyatomic interferences of different m/z ratios, so long as the relative collisional cross-sections of the interferer and analyte ions are as described above. Collisions with the inert gas cause a radial scattering of ions within a rod set. Higher order confinement fields, including hexapolar and octopolar fields, may be desirable because they can provide deeper radial potential wells than quadrupolar fields and therefore may provide better radial confinement. Quadrupolar fields are not strictly required for KED, because, a mass filter is not usually utilized to discriminate against product interferer ions. In KED, the downstream energy barrier discriminates against the interferer ions in terms of their average kinetic energies relative to that of the analyte ions. Use of the available higher order poles also tends to ease requirements on the quality of ion stream, such as width of the beam and energy distributions of the respective ion populations in the beam, which in turn can ease requirements on other ion optical elements in the mass spectrometer and provide more versatility overall.

In configurations where the cell is a reaction/collision cell, the cell make take the form of a cell described in commonly assigned U.S. Pat. No. 8,426,804, the entire disclosure of which is hereby incorporated herein by reference. The reaction/collision cell can operate in either the reaction mode (DRC mode) or the collision mode (KED mode) depending on how the cell is configured. An optional mode controller coupled to the mass spectrometer can control gas and voltage sources linked to the collision cell to enable selectable, alternate operation of the mass spectrometer in the two described modes.

Figure 7:
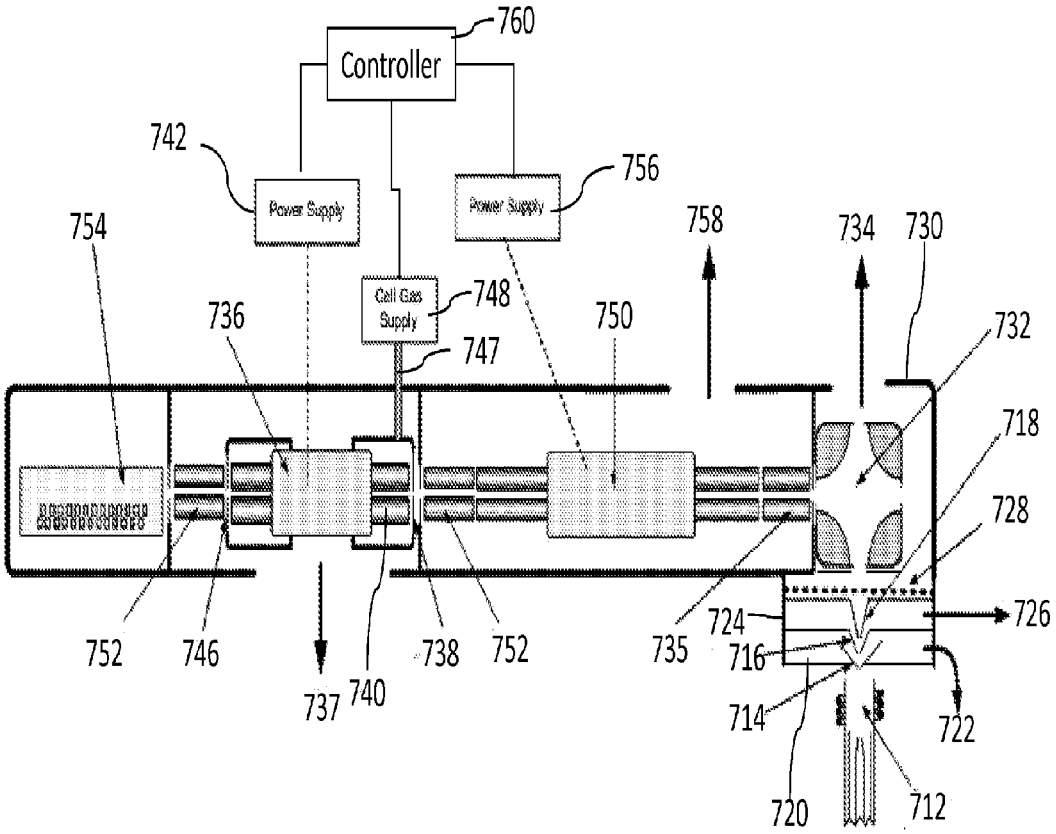
FIG. 7 is a schematic of a mass spectrometer comprising a cell downstream of a mass analyzer, in accordance with certain configurations.

Referring to FIG. 7, a mass spectrometer system 710, which can be used in ICP-MS to suppress unwanted ions, is shown. The mass spectrometer system 710 can comprise ion source 712, which can be an ICP ion source, but can also be some other type of ion source that generates substantial spectral interferences, including various known inorganic spectral interferences. Ion source 712, for example, can vaporize the analyte sample in a plasma torch to generate ions. Once emitted from the ion source 712, ions can be extracted into an ion stream or beam by passing successively through apertures in a sampler plate 714 and a skimmer 716. The ion extraction provided by the sampler plate 714 and skimmer 716 can result in a narrow and highly focused ion stream. The skimmer 716 can be housed in a vacuum chamber 720 evacuated by mechanical pump 722 to an atmospheric pressure of about 3 Torr, for example. In some embodiments, upon passing through the skimmer 716, the ions can enter into a second vacuum chamber 724 housing secondary skimmer 718. A second pump 726 can evacuate the second vacuum chamber 724 to a lower atmospheric pressure than the vacuum chamber 720. For example, the second vacuum, chamber can be maintained at or about 1 to 100 milliTorr. If the ion source 712 is an inductively coupled plasma source, then the ion stream passing through the skimmers 716 and 718 can suffer from spectral interferences. That is, the ion stream can be made up of populations of different kinds of ions, including one or more types of analyte ions that were ionized from the test sample. However, the ion stream may also contain populations of one or more types of interferer ions that were unavoidably introduced into the ion stream during ionization in the ICP. As described above, for inductively coupled plasma sources, which subject the test sample to very high temperature plasmas of argon typically, the above-listed inorganic spectral interferences (i.e. Ar+, ArO+, Ar2+, ArCl+, ArH+, and MAr+) may be especially present in the ion stream. The person of ordinary skill in the art, given the benefit of this disclosure, will recognize that the list is not limiting, in that other types or sources of spectral interferences may be present in the ion stream. The types of interferer ions may depend on the type of ion source 712 included in the mass spectrometer 710 and the selected analyte ion kind. Moreover, as described above, other non-spectral interferences may also be present in the ion stream, including photons of light, neutral particles and other gas molecules.

Each population (or group) of ions in the ion stream can comprise individual ions of like kind that make up the respective population. The various different populations of ions of different kinds can, together with other potential interferences, make up the ion stream or beam. Each particular kind of ion present in the ion stream will have a corresponding m/z ratio, though it will not necessarily be unique within the ion stream as the interferer type ions may have the same or similar m/z ratio as the analyte ions. For example, the ion stream could comprise a population of $^{56}Fe+$ analyte ions, together with a population of $^{40}Ar^{16}O^{+}$ interferer ions generated by the ICP. Each of these two ion types have m/z ratios of 56. As another non-limiting example, the analyte ion kind could be $^{80}Se^{+}$, in which case $^{40}Ar_2^{+}$ would constitute an interferer ion kind, each of m/z 80. In some embodiments, the interferer ion kind can be a polyatomic kind of ion. For example, $^{40}Ar^{16}O^{+}$ and $^{40}Ar_2^{+}$ ions would be two examples of polyatomic interferer ions. The analyte ion kind, i.e., native analyte ions, can be, on the other hand, a monatomic kind of ion comprising only a single ionized atom. In the above example, $^{56}Fe^{+}$ and $^{80}Se^{+}$ ions would be two corresponding examples of monatomic analyte ions. Because the interferer type ions can be of the polyatomic kind and the analyte ions of the monatomic kind, in some embodiments, the interferer type ions can also have a larger average collisional cross-section than the analyte ions.

The respective ion populations in the ion stream emitted from the ion source 712 can also define corresponding energy distributions with respect to the energies of the individual ions making up the populations. In other words, each individual ion in a respective population can be emitted from the ion source 712 having a certain kinetic energy. The individual ion energies taken over the ion population can provide an energy distribution for that population. These energy distributions can be defined in any number of ways, for example, in terms of a mean ion energy and a suitable metric providing a measure of the energy deviation from the mean ion energy. One suitable metric can be the range of the energy distribution measured at full-width at half-max (FWHM).

When the ion stream is emitted from the ion source 712, each population of ions in the stream can have respective initial energy distributions defined, in part, by corresponding initial ranges. These initial energy distributions need not be preserved as the ion stream is transmitted from the ion source 712 to downstream components included in the mass spectrometer 710. Some energy separation in the ion populations can be expected, for example due to collisions with other particles, field interactions, and the like. It may be convenient to describe the ion stream in terms of the respective energy distributions of its constituent ion populations at different locations throughout the mass spectrometer 710. In some embodiments, each ion population has substantially the same initial range of energy distributions when emitted from the ion source 712.

In some embodiments, ions passing through the skimmer 718 can be transmitted across interface gate 728 into a third vacuum chamber 730 enclosing an ion deflector 732, such as the quadrupole ion deflector seen in FIG. 7. The atmospheric pressure in the third vacuum chamber 730 can, by means of mechanical pump 734, be maintained at even lower levels than the second vacuum chamber 724. The ion stream encountering the ion deflector 732 along an entrance trajectory can be deflected through a deflection angle, such that the ion stream exits from the ion deflector 732 along an exit trajectory that is different from the entrance trajectory for processing in additional downstream components.

In certain embodiments, the ion deflector 732 can be configured as a quadrupole ion deflector, comprising a quadrupole rod set whose longitudinal axis extends in a direction that is approximately normal to entrance and exit trajectories of the ion stream (being the direction which is normal to the plane of FIG. 7). The quadrupole rods in the ion deflector 732 can be supplied with suitable voltages from a power supply (which can be a voltage source) to create a deflection field in the ion deflector quadrupole. Because of the configuration of the quadrupole rods and the applied voltages, the resulting deflection field can be effective at deflecting charged particles in the entering ion stream through an approximately 90 degree angle. The exit trajectory of the ion stream can thus be roughly orthogonal to the entrance trajectory (as well as to the longitudinal axis of the quadrupole). The ion deflector 732 arranged in the shown quadrupole configuration can selectively deflect the various ion populations in the ion stream (both analyte and interferer type ions) through to the exit, while other neutrally charged, non-spectral interferences are discriminated against. The ion deflector 732 can selectively remove light photons, neutral particles (such as neutrons or other neutral atoms or molecules), as well as other gas molecules from the ion stream, which have little or no appreciable interaction with the deflection field formed in the quadrupole on account of their neutral change. The ion deflector 732 can be included in the mass spectrometer 710 as one possible means of eliminating non-spectral interferers from the ion stream, and in embodiments of the mass spectrometer 710 where no other means of achieving the same result may be convenient. As can be selected by the person of ordinary skill in the art, given the benefit of this disclosure, there are other techniques to eliminate or reduce non-spectral interferers from the ion stream prior to introducing the ion beam into the cell.

The ion stream once exiting the ion deflector 732 along the exit trajectory can be transmitted to an entrance end of a mass analyzer 750 located upstream of a pressurized cell 736 by way of pre-filter rods 735. Mass analyzer 750 can generally be any type of suitable mass analyzer including, but without limitation, a resolving quadrupole mass analyzer, a hexapole mass analyzer, a time-of-flight (TOF) mass analyzer, a linear ion trap analyzer, or some combination of these elements. As shown in FIG. 7, mass analyzer 750 comprises a quadrupole and can be configured for Mass-Selective Axial Ejection (MSAE) as described in U.S. Pat. No. 6,177,668, the entire contents of which are herein incorporated by reference. Accordingly, voltage source 756 can be linked to the upstream mass analyzer 750 to supply suitable RF/DC voltages and, optionally, an auxiliary voltage for use in MSAE as described in U.S. Pat. No. 6,177,668. Ions received into the mass analyzer 750 can be mass differentiated (in the case of MSAE, in space, not time) and transmitted to the pressurized cell 736 for reaction, collision or reaction/collision. Voltage source 756 can also supply an offset (dc) bias voltage to the mass analyzer 750. The mass analyzer 750 can be housed in a vacuum chamber evacuated by the mechanical pump 758.

Native analyte ions selected by the mass analyzer 750 can be provided to a pressurized cell 736 by way of post-filter rods 752, and thereby admitted into the pressurized cell 736 through a suitable entrance member of the pressurized cell 736, such as entry lens 738, located at an entrance end of the pressurized cell 736. The entry lens 738 can provide an ion inlet for receiving the ion stream into the pressurized cell 736. Downstream of the entry lens 738 at an exit end of the pressurized cell 736, a suitable exit member, such as exit lens 746, may also be provided. Exit lens 746 may provide an aperture through which ions traversing the pressurized cell 736 may be ejected to downstream components of the mass spectrometer 710, e.g., to the detector 754. The entry lens 738 can have, for example, a 4.2 mm entry lens orifice, as compared to a 3 mm exit lens orifice of the exit lens 746, though other size orifices may be viable as well to receive and eject the ion stream from the pressurized cell 736. Also, the pressurized cell 736 can be generally sealed off from the vacuum chamber 730 to define an interior space suitable for housing quantities of a collision (either reactive or inert) gas, as described in more detail below.

In some configurations, the pressurized cell 736 can be a quadrupole pressurized cell enclosing a quadrupole rod set 740 within its interior space. The quadrupole rod set 740 can comprise four cylindrical rods arranged evenly about a common longitudinal axis that is collinear with the path of the incoming ion stream from the mass analyzer 750. The quadrupole rod set 740 can be linked to voltage source 742, for example using power connection 744, to receive an RF voltage therefrom suitable for creating a quadrupolar field within the quadrupole rod set 740. As will be appreciated, the field formed in the quadrupolar rod set 740 can provide radial confinement for ions being transmitted along its length from the entrance end toward the exit end of the pressurized cell 736. As illustrated better in FIGS. 8A-8B, diagonally opposite rods in the quadrupole rod set 740 can be coupled together to receive out-of-phase RF voltages, respectively, from the voltage source 742. A DC bias voltage may also, in some instances, be provided to the quadrupole rod set 740. Voltage source 742 can also supply a cell offset (dc bias) voltage to the pressurized cell 736. If desired, the quadrupole rod set 740 can be aligned collinearly with the entry lens 738 and exit lens 746 along its longitudinal axis, thereby providing a complete transverse path through the pressurized cell 736 for ions in the ion stream. An entrance ellipse of the quadrupole rod set 740 can be aligned with the entry lens 738 to receive the incoming ion stream. The entry lens 738 may also be sized appropriately (e.g. 4.2 mm) to direct ion stream entirely, or at least substantially, within the entrance ellipse and to provide the ion stream having a selected maximum spatial width, for example but without limitation, in the range of 2 mm to 3 mm. The entry lens 738 can be sized so that most or all, but at a minimum a substantial part, of the ion stream is directed into the acceptance ellipse of the quadrupole rod set 740. The skimmers 716 and 718 may also be sized to affect the spatial width of the ion stream.

A gas inlet 747 may also be included in the pressurized cell 736 providing fluid communication between a source of gas 748 and the interior space of pressurized cell 736. The source of gas 748 can be operable to inject a quantity of a selected gas into the pressurized cell 736 to collide with ions in the ion stream. The source of gas 748 may, according to embodiments, be selectable between a plurality of different types of gas. For example, the source of gas 748 may provide a quantity of an inert gas within the pressurized cell 736 to a predetermined pressure, the gas being for example helium or neon. More generally, the inert gas can be any gas that is substantially inert toward both an analyte ion kind and an interferer ion kind in the ion stream. Assuming a first group of ions in the ion stream of a first polyatomic interfering kind, and a second group of ions in the ion stream of a second monatomic analyte kind, the chosen inert collision gas may collide with a substantially larger proportion of the first group of ions than with the second group of ions, to reduce the energies of the individual ions in the first group to a greater extent on average than the individual ions in the second group. Accordingly, the inert gas can be of a type that is suitable for operating the pressurized cell 736 for KED. The source of gas 748 may also provide the pressurized cell 736 with a quantity of a reactive gas selected from a plurality of different reactive gas types. The reactive gas can be selected, for example, to be reactive with an interferer ion kind, while at the same time being inert toward one or more analyte ion kinds. Alternatively, the selected reactive gas can be inert toward the interferer ion kind and reactive with one or more of the analyte ions. Embodiments of the invention may be directed to either scenario. For example, but without limitation, the source of gas 748 may provide the selected reactive gas within the pressurized cell 736 in the manner described in U.S. Pat. Nos. 6,140,638 and 6,627,912. Accordingly, if the reactive gas is selected to be reactive with the interferer ion kind, mass filtering may then be performed in the pressurized cell 736 to transmit only the analyte ion kind. Alternatively, the reactive gas may be selected to be reactive with a population of ions, other than a spectral interferer kind, in order to generate analyte product ions of interest. One type of reactive gas that can be selected is ammonia ($NH_3$), though other reactive gases such as oxygen or other suitable reactive gases can also be used. The reactive gas can also be provided within the pressurized cell 736 up to a predetermined pressure, which can be the same predetermined pressure as the inert gas, but can also be a different predetermined pressure. However, in some embodiments, both the inert and the reactive gas can be provided within the pressurized cell 736 to a predetermined pressure within the range of 1 milliTorr to 40 milliTorr.

A pump 737, which can be a mechanical pump like pumps 722, 726 and 734, can also be fluidically coupled to the pressurized cell 736 and can be operable to evacuate gas that is housed within the pressurized cell 736. Through synchronous operation of the pump and the source of gas 748, the pressurized cell 736 may be repeatedly and selectively filled with, and then emptied of, a suitable collision gas during operation of the mass spectrometer 710. For example, the pressurized cell 736 may be filled with and then emptied of a quantity of an inert gas, alternately with filling and emptying of a quantity of a selected reactive gas provided by the source of gas 748. In this way, the pressurized cell 736 may be made suitable for alternate and selective operation in the DRC and KED modes. As will be appreciated, however, and as described in more detail below, other parameters of other components of the mass spectrometer 710 may also be adjusted based on the mode of operation. If desired, the entry lens 738 can be maintained at or slightly less than ground potential, thereby minimizing any ion field interactions at the entry lens 738 that could otherwise cause energy separation in the ion populations. For example, the entry lens 738 can be supplied by the power supply 742 with an entrance potential falling in the range between −5V and +2V. Alternatively, the entry potential supplied to the entry lens 738 can be in the range between −3V and 0 (ground potential). Maintaining the magnitude of the entry potential at a relatively low level can help to keep the corresponding energy distributions of different ion groups in the ion stream within a relatively small range. The exit lens 746 can also be supplied with a DC voltage by the voltage source 742 so as to be maintained at a selected exit potential. In some embodiments, the exit lens 746 can receive a lower (i.e. more negative) exit potential than the entrance potential provided to the entry lens 738, to attract positively charged ions in the pressurized cell 736 toward to the exit end of the pressurized cell 736. Moreover, the absolute magnitude of the exit potential can be larger, perhaps even significantly larger, than the supplied entrance potential. The exit potential at which the exit lens 746 can be maintained may, in some embodiments, be within the range defined between −40V and −18V. The exit potential may more particularly be somewhere within the range −35V to −25V. It should be appreciated that it is not strictly necessary for the exit lens 746 and entry lens 738 to be supplied by the same voltage source, in this case voltage source 742. One or more different voltage sources may be linked to these components (or any other components in the system 710) to provide voltages.

A post filter 752 can be interposed between the pressurized cell 736 and the upstream mass analyzer 750 for use as a transfer element between these two components. Accordingly, post-filter 752 can be operated in RF-only mode to provide radial confinement of the ion stream between the pressurized cell 736 and the upstream mass analyzer 750 and to reduce the effects of field-fringing that might otherwise occur. In other embodiments, post-filter 752 may also receive a DC voltage to provide additional mass filtering of ions before transmission into the pressurized cell 736, for example to address space charge issues, or the like. As described herein above, the pressurized cell 736 can be supplied with a cell offset voltage and the mass analyzer 750 (or the detector 754) can be supplied with a downstream offset voltage, which can be dc voltages supplied by a single or multiple different voltage sources linked to the corresponding component. The amplitude of each applied offset voltage can be fully controllable. Indirectly, therefore, or perhaps directly, the difference between the cell offset and downstream voltages can also be controlled.

In one configuration, the detector offset voltage can be more positive than a cell offset voltage, thereby maintaining the cell 736 at an electrical potential above the detector 754. For positive ions transmitting from the pressurized cell 736 to the detector 754, this potential difference can present a positive potential barrier for ions to overcome. In other words, the relative positive difference can create an exit barrier at the downstream end of the cell 736 for ions to penetrate. Therefore, ions with at least a certain minimum kinetic energy can penetrate the exit barrier, while slower ions not having sufficient kinetic energy can be trapped within the pressurized cell 736. If the strength of the exit barrier is selected appropriately, for example through control of the size of the potential difference between the detector 754 and the pressurized cell 736, then the exit barrier can discriminate selectively against one population or group of ions relative to another, such that a greater proportion of the one group of ions relative to the other may be trapped by the barrier and prevented from exiting the pressurized cell 736. Controlling the downstream offset voltage to be more positive than the cell offset voltage can render the mass spectrometer 710 suitable, for example, for KED operation.

In another case, the downstream and cell offset voltages (and thus also the difference therebetween) can be controlled to make the cell offset voltage more positive than the downstream offset voltage. With the offset voltages thus controlled, the mass spectrometer 710 can be suitable for DRC operation. Rather than providing an exit barrier as in the above described case, maintaining the detector 754 at a lower electrical potential than the pressurized cell 736 can accelerate ions into the detector 754 from the pressurized cell 736 and provide more efficient transmission of analyte ions between these two stages. As noted above, the interferer ions can react with the reactive gas to form product ions, which can then be destabilized and ejected by tuning the pressurized cell 736 to apply a narrow bandpass filter around the m/z of the analyte ions. This way only the analyte ions can be accelerated into the detector 754. If a trapping element is provided downstream of the pressurized cell 736, the accelerating force provided by the potential drop can also sometimes be an effective way to induce in-trap ion fragmentation of the analyte ions, for example, if fragmentation is wanted.

Optional mode controller 760 can control and coordinate operation of the mass spectrometer 710 for dual KED/DRC operation. For this purpose, mode controller 760 can be linked/coupled to each of the gas source 748, the pump, the voltage source 742 for the pressurized cell 736, and the voltage source 756 for the upstream mass analyzer 750, as well as any other voltage or gas sources included in the mass spectrometer 710 not shown in FIG. 7. Accordingly, mode controller 760 can be operable to switch the cell 736 from the KED to the DRC mode of operation, and further from the DRC back to the KED mode of operation. More generally, the mode controller 760 can selectably switch between these two modes of operation. As will be described in more detail, in order to make the switch from one mode of operation to the other, the mode controller 760 can set, adjust, reset, or otherwise control, as needed, one or more settings or parameters of the mass spectrometer system 710 based one or more other setting or parameters. The mode controller 760 can comprise both hardware or software components, including a processor and memory linked to the processor. As is known, the processor can be provided in the form of a central processing unit (CPU), a microcontroller or microprocessor, a general purpose computer, an application specific processing unit, and the like. The memory can comprise both volatile and non-volatile storage media on which executable instructions for the processor, as well as other system data, can be stored in non-transitory form. The mode controller 760 can also comprise a database of information about atoms, molecules, ions, and the like, which can include the m/z ratios of these different compounds, ionization energies, and other common information. The database can include further data relating to the reactivity of the different compounds with other compounds, such as whether or not two compounds will form molecules or otherwise be inert toward each other. The instructions stored in the memory can execute a software module or control routine for the mass spectrometer 710, which in effect can provide a controllable model of the system. As will be described in more detail below, the mode controller 760 can use information accessed from the database together with one or software modules executed in the processor to determine control parameters or values for different modes of operation for the mass spectrometer 710, including the KED and DRC modes of operation. Using input interfaces to receive control instructions and output interfaces linked to different system components in the mass spectrometer 710, the mode controller 760 can perform active control over the system.

For example, in the KED mode of operation, the mode controller 760 can enable a source of the inert gas in the gas source 748, such as helium, and then drive the gas source 748 to fill the pressurized cell 736 with a quantity of the inert gas up to predetermined pressure. The mode controller 760 can also set the downstream offset voltage to be more positive than the cell offset voltage, thereby forming the exit barrier at the exit end of the pressurized cell 736. For example, the mode controller 760 can control the downstream voltage to be between 2V and 5V more positive than the cell offset voltage when operating in the KED mode. Ions admitted into the pressurized cell 36 be collide with the inert collision gas and undergo reductions in their respective kinetic energies. The average reduction in kinetic energy can depend on the average collisional cross-section of the ion kind, with ions of a larger collisional cross-section tending to undergo greater reductions in kinetic energy, relative to ions with a smaller cross-section, even where the two kinds of ions have substantially the same or similar m/z ratios. Thus, due to collisions with the inert gas, a group of polyatomic interferer ions can have its average kinetic energy reduced to a greater extent than a group of monatomic analyte ions. If the corresponding energy distributions of these two groups of ions are controlled during transmission, from the ion source 712 to the pressurized cell 736, to be within the selected maximum range for the mass spectrometer 710, then collision with the inert gas can introduce an energy separation between the two groups. A larger proportion of the interferer ion group can experience reduced energies relative to the analyte ion group with the effect that, through mode controller 760 controlling the size of the exit barrier, a greater proportion of the interferer ions will be unable to penetrate the exit barrier than the analyte ions.

The desired amplitude of the exit barrier can generally depend on the interferer and analyte ion kinds, and therefore the mode controller 760 may control the difference between the downstream and cell offset voltages based on one or both of the interferer and analyte ion kinds. For example, mode controller 760 can determine a voltage difference in the above listed range of 2V to 5V based upon the interferer and/or analyte ion kinds. Additionally, the mode controller 760 may control the difference based upon other system parameters, such as the entry or exit potentials applied to the entry lens 738 and the exit lens 746, respectively. The mode controller 760 can also be configured to adjust or tune the downstream and cell offset voltages forming the exit barrier to improve kinetic energy discrimination between the interferer and analyte ions. Moreover, the mode controller 760 can also be configured to adjust the entrance potential applied to the entry lens 738 in order to control the range of energy distributions of the constituent ion populations entering into the pressurized cell 736. The mode controller 760 may also control the RF voltage supplied to the quadrupole rod set 740 by the voltage source 742 in order to set or adjust the strength of the quadrupolar confinement field. In this way, the mode controller 760 can set the quadrupolar confinement field within the quadrupole rod set 740 to strength sufficient to confine at least a substantial portion of analyte ions within the quadrupole rod set 740 when scattered due to collision with the inert gas. Any of the above determinations by the mode controller 760 may be based upon interferer and/or analyte ion kind.

To switch from the KED mode to the DRC mode of operation, mode controller 760 can instruct the pump to evacuate the inert gas from the pressurized cell 736 and can enable a selected reactive gas in the gas source 748 to be pumped into the pressurized cell 736 to a predetermined pressure, for example. The reactive gas selected can be one that is substantially inert toward the analyte ions but reactive with the interferer ions (or vice versa). The mode controller 760 can also, for example by accessing a linked database, determine one or more types of potential interferer ions based upon one or more identified analyte ions of interest. The interferer ion kinds determined by the mode controller 760 may have substantially the same or similar m/z ratios as the analyte ion kinds. The mode controller 760 can also select a suitable reactive gas in a similar way. Once a suitable reactive gas has been selected and enabled in the gas source 748, mode controller can control the gas source 748 to inject a quantity of the reactive gas into the pressurized cell 736.

For operation in the DRC mode, the mode controller 760 may control operation of the mass spectrometer 710 substantially as described in U.S. Pat. Nos. 6,140,638 and 6,627,912. Additionally, the mode controller 760 can be configured to instruct the voltage source 742 to supply a downstream offset voltage that is more negative than the cell offset voltage. The difference between these two voltages may be controlled by the mode controller 760, for example, to lie within the range between 4V and 6V, so that the cell 736 is at an electrical potential that is between 4V and 6V more negative than the detector 754. The determination of the difference may again be made based upon the interferer and/or analyte ion kinds. The mode controller 760 may also be configured to adjust or tune the offset voltage difference.

To switch from the DRC mode of operation back to the KED mode of operation, the mode controller 760 can instruct the pump to evacuate the selected reactive gas from the pressurized cell, and subsequently control the gas source 748 to provide a quantity of the inert gas within the pressurized cell. The downstream and cell offset voltages, as well as other system parameters, may also be adjusted by the mode controller 760 as described above to be suitable for KED operation.

Figure 8A:
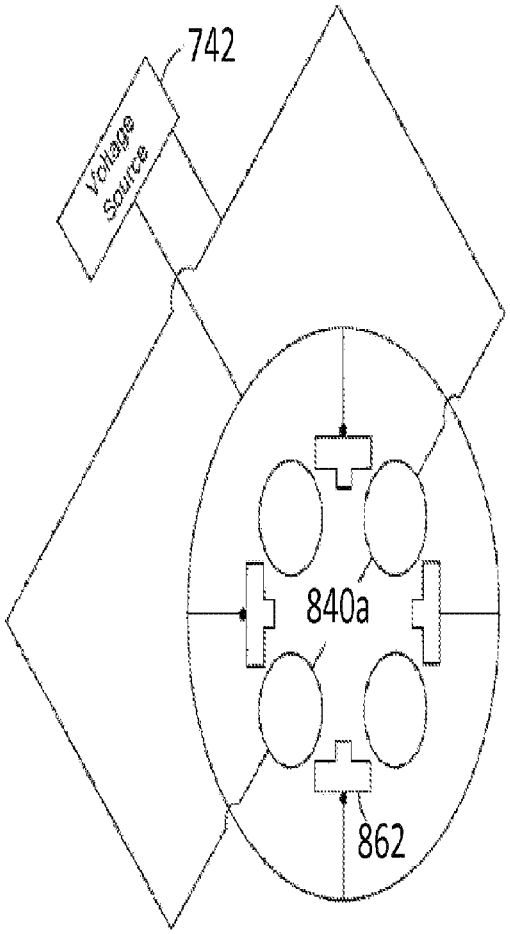
FIG. 8A, in front cross-sectional view, illustrates a set of auxiliary electrodes that can be included in the mass spectrometer system shown in FIG. 7, and FIG. 8B, in a rear cross-sectional view, illustrates the set of auxiliary electrodes shown in FIG. 8A, in accordance with certain configurations.
Figure 8B:
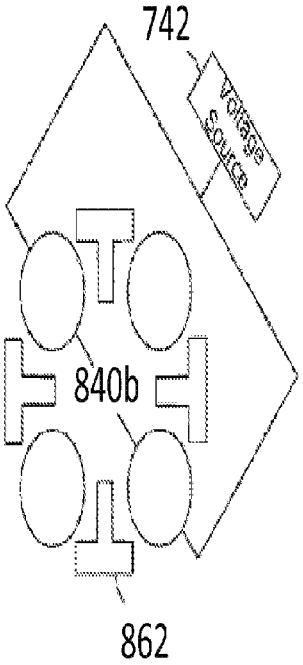

With reference now to FIGS. 8A-8B, illustrated therein, in front and rear cross-sectionals views, respectively, are auxiliary electrodes 862 that can be included in alternative embodiments. These figures illustrate quadrupole rod set 840 and voltage source 842, as well as the connections therebetween. The pair of rods 840*a* can be coupled together (FIG. 8A) as can the pair of rods 840*b* (FIG. 8B) to provide the quadrupolar confinement field. For example, the pair of rods 840*a* can be supplied with a voltage equal to $Vo+A\cos\omega t$, where A is the amplitude of the supplied RF and Vo is a dc bias voltage. For quadrupolar operation, the pair of rods 84 *b* can then be supplied with a voltage equal to $-Vo-A\cos\omega t$. The auxiliary electrodes 862 can be included in the pressurized cell 736 to supplement the quadrupolar confinement field with an axial field, i.e. a field that has a dependence on axial position within the quadrupole rod set. As illustrated in FIGS. 8A-8B, the auxiliary electrodes can have a generally T-shaped cross-section, comprising a top portion and a stern portion that extends radially inwardly toward the longitudinal axis of quadruple rod set. The radial depth of the stem blade section can vary along the longitudinal axis to provide a tapered profile along the length of the auxiliary electrodes 862. FIG. 8A shows the auxiliary electrodes from the downstream end of the pressurized cell 736 looking upstream toward the entrance end, and FIG. 8B shows the reverse perspective looking from the entrance end downstream to the exit end. Thus, the inward radial extension of the stem portions lessens moving downstream along the auxiliary electrodes 862.

Each individual electrode can be coupled together to the voltage source 742 to receive a dc voltage. As will be appreciated, this geometry of the auxiliary electrodes 862 and the application of a positive dc voltage can create an axial field of a polarity that will push positively charged ions toward the exit end of the pressurized cell 736. It should also be appreciated that other geometries for the auxiliary electrodes could be used to equal effect, including, but not limited to, segmented auxiliary electrodes, divergent rods, inclined rods, as well as other geometries of tapered rods and reduced length rods. Neglecting fringe effects at the ends of the rods and other practical limitations, the axial field created by the auxiliary electrodes can have a substantially linear profile. The gradient of the linear field can also be controllable based upon the applied dc voltage and the electrode configuration. For example, the applied dc voltage can be controlled to provide an axial field gradient in the range between 0.1 V/cm and 0.5 V/cm. In some embodiments, the axial field gradient can be controlled so that the axial field gradient is in the range between 0.15 V/cm and 0.25 V/cm. For a given electrode geometry, it will be well understood how to determine a required dc voltage to achieve a desired axial field gradient. But for example, without limitation, dc voltages in the range 0 to 475 V can be used.

The mode controller 760 can also control the voltage source 742 so that the supplied dc voltage to the auxiliary electrodes 862 forms an axial field of a selected field strength, defined for example in terms of its axial gradient. The auxiliary electrodes 862 may be energized for each of the KED and DRC modes of operation, though at different field strengths. Mode controller 760 may control the relative field strengths for each mode of operation. In either mode of operation, the auxiliary electrodes 762 can be effective in sweeping reduced energy ions out of quadrupolar field by pushing the ions toward the exit end of the pressurized cell 736. The magnitude of the applied axial field strength can be determined by the mode controller 760 based upon the interferer and analyte ion kinds in the ion stream, as well as other system parameters as described herein.

Where one or more cells are present, each cell can be independently controlled from the other cells. For example, any one cell can be configured to permit switching between at least two modes comprising a collision mode and a reaction mode. The cell can be configured to receive a collision gas in a collision mode to pressurize the cell and configured to receive a reaction gas in a reaction mode to pressurize the cell. If desired, the cell may comprise a quadrupole rod set. The controller can be electrically coupled to the quadrupole rod set of the cell and configured to provide a waveform from a voltage source to the quadrupole set to provide a quadrupolar field within the cell. For example, the controller can be configured to provide an effective voltage from the voltage source to the cell in the collision mode to select ions comprising an energy greater than a barrier energy and an effective voltage from the voltage source in the reaction mode to select ions using mass filtering. In some configurations, the effective voltage provided to the cell in the collision mode and the reaction mode is an offset voltage. In some instances, a third or vented mode may be implemented to permit transmission of ions by the cell to a detector or other downstream component. In some instances, the systems can include a gas manifold coupled to the cell and configured to provide the collision gas in the collision mode and the reaction gas in the reaction mode. If desired, the entrance and/or exit apertures of the cell can be electrically coupled to the controller. The controller may be configured to switch the cell between the collision mode and the reaction mode by exhausting the cell prior to introduction of a reaction gas into the cell. Alternatively, the controller can be configured to switch the cell between the reaction mode and the collision mode by exhausting the cell prior to introduction of a collision gas into the cell. In some configurations, the cell may comprise an offset voltage that is more positive than an offset voltage of a downstream component. e.g., a detector or second cell, when the cell is operated in the collision mode. In other configurations, the cell comprises an offset voltage that is more negative than an offset voltage of a downstream component, e.g., a detector or second cell, when the cell is operated in the reaction mode. Where two or more cells are present, one of the cells can be operated in the collision mode or the reaction mode and the other cell can be configured to operate in a vented mode.

In certain configurations, the cells described herein may be independently switched between modes by introducing a first ion stream into the cell, the cell configured to receive a collision gas in a collision mode to pressurize the cell and configured to receive a reaction gas in a reaction mode to pressurize the cell, the cell comprising a quadrupole rod set operative to provide a quadrupolar field within the cell. Introduced ions in the ion stream/beam comprising an energy greater than a barrier energy from the introduced first ion stream can be selected by introducing a collision gas into the cell in the collision mode, the cell comprising a voltage effective to permit selection of the ions comprising the energy greater than the barrier energy. The first ion stream can then be exhausting from the cell. A second ion stream can then be introduced into the cell. Ions can be selected using mass filtering from the introduced second ion stream by introducing a reaction gas in the reaction mode, the cell comprising a voltage effective to permit selection of the ions using the mass filtering. This process can be repeated and may vary from cell to cell. For example, where two or more pressurized cells are present in a system, each cell may be controlled as described in reference to the cell of FIG. 7. The cells can be independently controlled such that they perform different functions or perform the same function. Where multiple cells are configured as DRC cells, different reactant gases can be introduced into different cells to further discriminate between ions. Similarly, different collision gases can be introduced into different cells if desired.

In certain embodiments, the ion sources described herein can be sustained using many different types of induction device or capacitive devices. For example, an induction coil can be used to sustain an inductively coupled plasma. In other instances, one or more plate electrodes can be used to sustain an inductively coupled plasma, a capacitively coupled plasma or a plasma sustained using both inductively coupled and capacitively coupled energy. In some embodiments where more than two plate electrodes are present, the spacing between the plates may be the same, e.g., symmetric spacing, or may be different, e.g., asymmetric spacing. Illustrative induction and capacitive devices are described in commonly assigned U.S. Pat. Nos. 7,106,438, 8,263,897, and 8,633,416 and U.S. Patent Publication No. 20110273260, the entire disclosure of each of which is hereby incorporated herein by reference. In some embodiments, a glow discharge ion source can be used in the systems described herein. Without wishing to be bound by any particular theory, a glow discharge source generally comprises a plasma sustained by passing an electric current through a low pressure gas. Voltage is applied between two electrodes in a gas tube comprising the gas. The gas ionizes in the tube and causes a glow. Glow discharge sources are "dirty" sources in that they tend to provide substantial amounts of interfering ions due to the lower temperature of glow discharge ion sources. The presence of a mass analyzer upstream of a cell in the systems described herein, permits the use of glow discharge sources, which can be cheaper and beneficial in portable, low power or low gas flow applications. For example, by ionizing a sample using a glow discharge source, the ion of interest along with a substantial number of interfering species can be provided first to a mass analyzer and then to a downstream cell to remove substantially all (or all) interfering species from the ion of interest. The use of less efficient ionization sources while still permitting accurate detection of a single ion of interest can reduce overall instrument cost and/or operating costs. In some embodiments, the ion source can be, for example, a microwave-induced plasmas, drift ion devices, devices that can ionize a sample using gas-phase ionization (electron ionization, chemical ionization, desorption chemical ionization, negative-ion chemical ionization), field desorption devices, field ionization devices, fast atom bombardment devices, secondary ion mass spectrometry devices, electrospray ionization devices, probe electrospray ionization devices, sonic spray ionization devices, atmospheric pressure chemical ionization devices, atmospheric pressure photoionization devices, atmospheric pressure laser ionization devices, matrix assisted laser desorption ionization devices, aerosol laser desorption ionization devices, surface-enhanced laser desorption ionization devices, glow discharges, resonant ionization, thermal ionization, thermospray ionization, radioactive ionization, ion-attachment ionization, liquid metal ion devices, laser ablation electrospray ionization, or combinations of any two or more of these illustrative ionization devices/sources.

In certain configurations, the mass analyzers of the systems described herein can be a quadrupole mass filter (as noted in connection with FIG. 7), a magnetic sector mass analyzer, a time-of-flight mass analyzer, an ion trap, e.g., quadrupole ion trap, orbitrap, a cyclotron or other suitable mass analyzers. As noted herein, in some cases it is desirable that only a single mass analyzer be present in the system.

In certain instances, the detectors of the system described herein can be configured to receive ions from a cell and detect the ions. The exact configuration of the detectors can vary from system to system, and in certain instances, the detector may comprise an electron multiplier, a Faraday cup, a microchannel plate, an inductive detector or other suitable detectors that can detect an induced charge or current that results from incident ions. Illustrative types of detectors are described, for example, in commonly assigned U.S. patent application Ser. Nos. 14/082,512, 14/082,685, and 61/909,091, the entire disclosure of each of which is hereby incorporated herein by reference.

Certain specific examples are described below to illustrate better some of the novel aspects of the technology described herein.

Example 1

Figure 9:
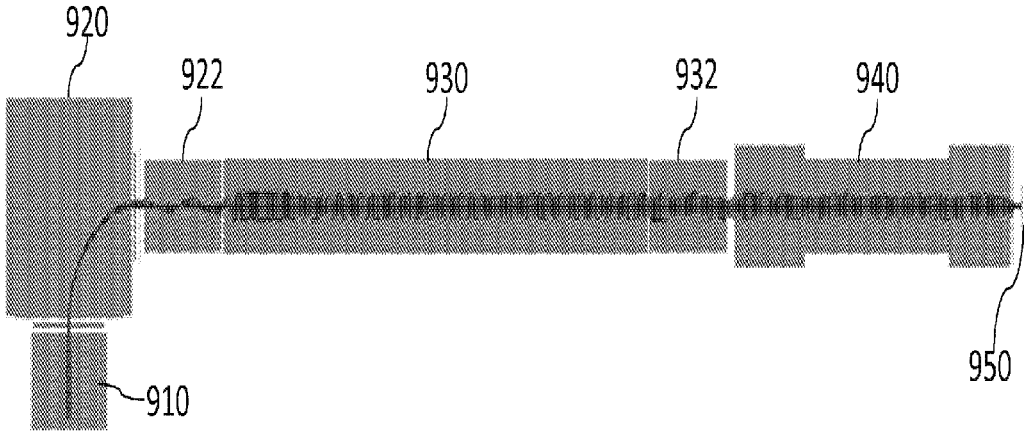
FIG. 9 is an illustration showing a simulation of ions in a non-pressurized cell, in accordance with certain examples.

An ion simulation was performed based on the system components shown in FIG. 9 using SimIon® Ion and Electron Optics simulator software. The simulated system included an ion source 910 fluidically coupled to a deflector 920. Pre-filters 922 are fluidically coupled to a deflector 920 and to a downstream mass analyzer 930. A cell 940 is downstream and fluidically coupled to the mass analyzer 930 through post-filters 932. A detector 950 is fluidically coupled to a cell 940. Target ions of the simulation had a mass of 56 amu. The cell used was not pressurized and had a cell pressure of 0.1 Pascals. The ion flow through the system is shown in FIG. 9 as the dark line. All ions were transmitted to the detector 950.

Example 2

Figure 10A:
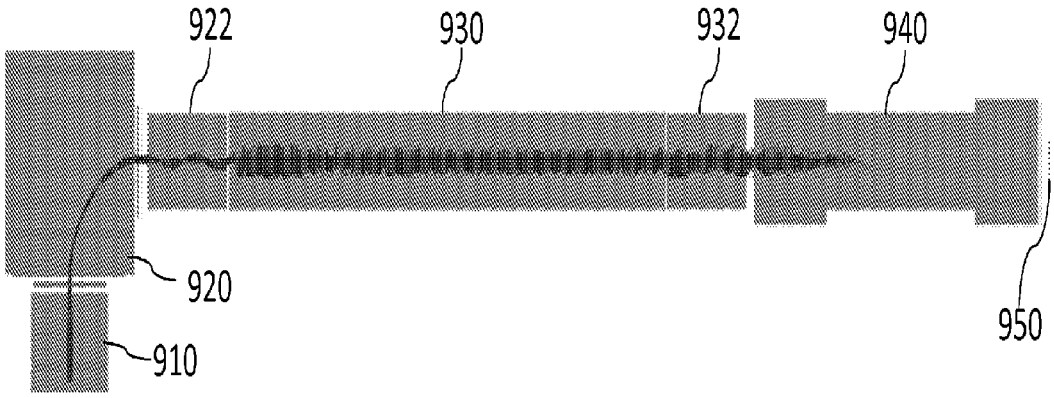
FIGS. 10A and 10B are illustrations showing simulations of removal of interfering ions, in accordance with certain examples.
Figure 10B:
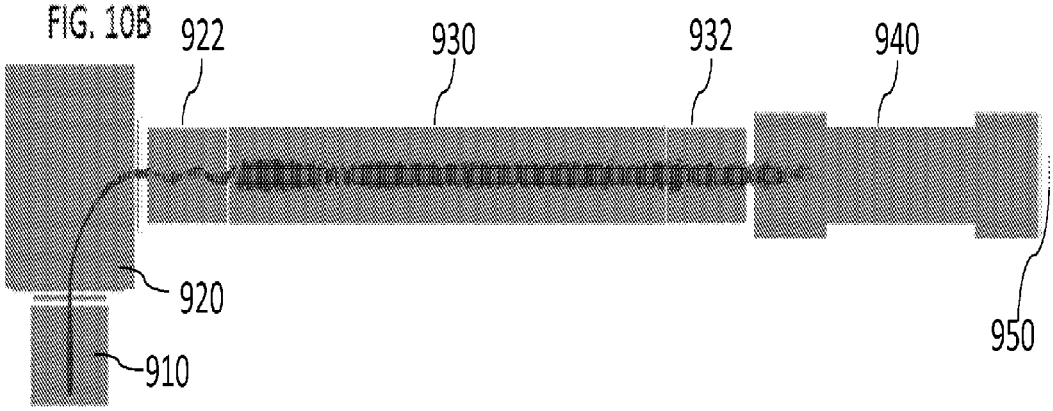
Figure 11:
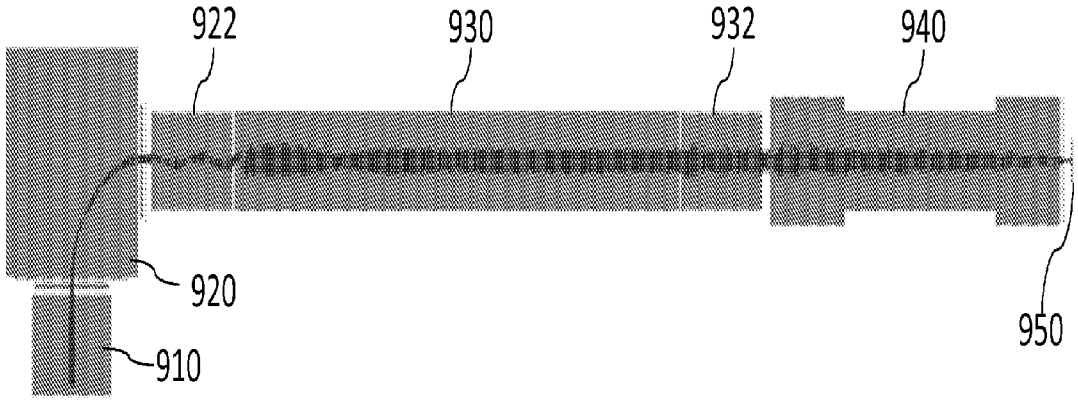
FIG. 11 is an illustration showing a simulation of passage of analyte ions, in accordance with certain examples.

Another ion simulation was performed using a pressurized cell and the SimIon® software. The same components in the simulation of Example 1 were used. FIG. 10A shows the simulation with a target mass of 56 amu at a cell pressure of 0.66 Pascals in a reaction mode using ammonia gas. FIG. 10B shows the simulation with a target mass of 56 amu at a cell pressure of 1.33 Pascals. The simulated ions were interfering $^{40}Ar^{16}O^{+}$. As shown in the simulations, the interfering species were removed upon reaction with the ammonia gas.

Example 3

An ion simulation was performed using a cell pressurized at 1.33 Pascals and the SimIon® software. The same components in the simulation of Example 1 were used. The target ions were those with a mass of 56 amu. The reaction mode of the cell was used. An axial field voltage of 400 Volts was used. After two consecutive collisions with reaction gas, $^{56}Fe^{+}$ successfully was transmitted through the cell as it does not react with the reaction gas to any substantial degree.

Example 4

Figure 12A:
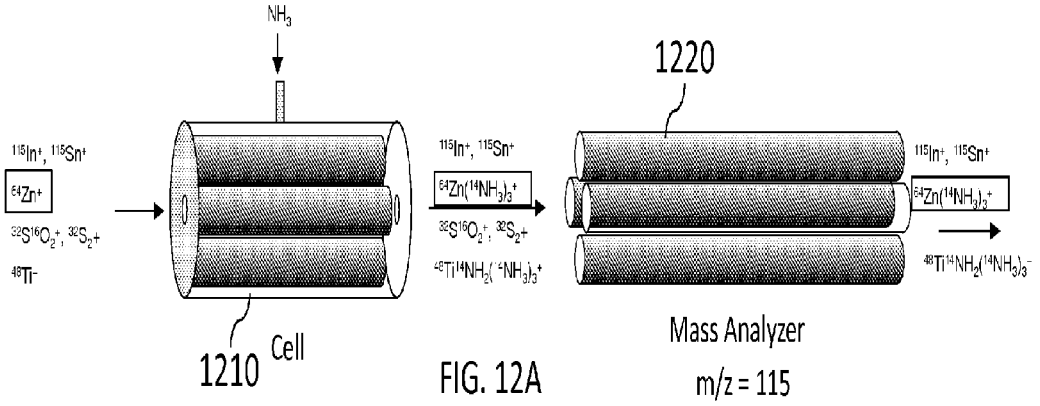
FIGS. 12A-15B show simulation schematics for various mass analyzer/cell arrangements, in accordance with certain examples.
Figure 12B:
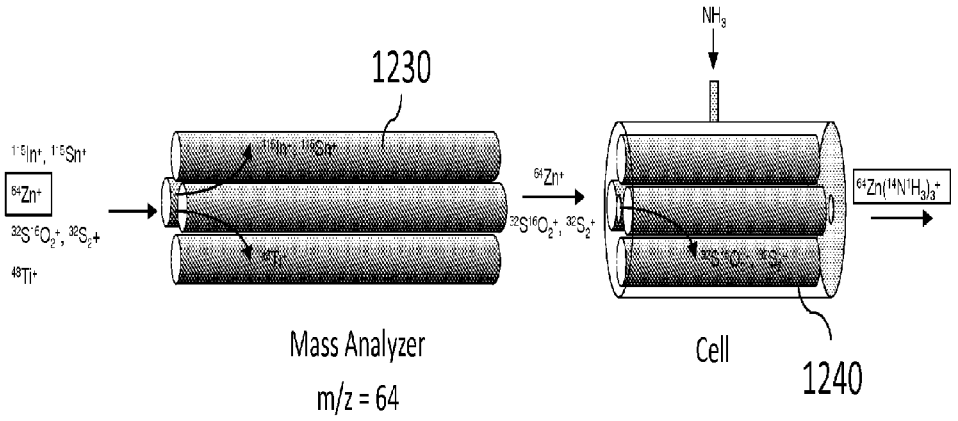

Ion simulations were performed to compare the results of a conventional system (FIG. 12A) where the cell 1210 is upstream of a mass analyzer 1220, and a new system (FIG. 12B) where the cell 1240 is downstream of the mass analyzer 1230. The simulation of zinc (m/z of 64) reaction products with ammonia was performed. The matrix introduced into the cell 1210 (FIG. 12A) includes $^{115}In^{+}$, $^{116}Sn^{+}$, $^{64}Zn^{+}$, $^{32}S^{16}O^{2+}$, $^{32}S_2$+ and $^{48}Ti^{+}$. The resulting reaction products with ammonia include $^{115}In^{+}$, $^{116}Sn^{+}$, $^{64}Zn(^{14}NH_3)^{3+}$, $^{32}S^{16}O^{2+}$, $^{32}S_2$+, and $^{48}Ti^{14}NH_2(^{14}NH_3)^{3+}$. The reaction products are then provided to the mass analyzer 1220. Due to the matrix interferences present with m/z 115, four products will be selected ($^{115}In^{+}$, $^{116}Sn^{+}$, $^{64}Zn(^{14}NH_3)^{3+}$ and $^{48}Ti^{14}NH_2(^{14}NH_3)^{3+}$. The output from the mass analyzer 1220 includes species other than the desired zinc species. These additional species will also be provided to the detector (not shown), which will result in inaccurate measurements.

When the same simulation is performed with the mass analyzer 1230 upstream of the cell 1240 (FIG. 12B), ions with m/z of 64 can be first selected from the matrix to provide $^{64}Zn$+, $^{32}S^{16}O^{2+}$, and $^{32}S_2^{+}$. These three species are then provided to the reaction cell 1240. Ammonia reacts with zinc ions and permits their passage in the form of $^{64}Zn(^{14}NH_3)^{3+}$, and the sulfur species are removed from the sample stream provided to the cell 1240. The output of the cell 1240 comprises only the zinc ions (as a reaction product), which can be provided to a detector for detection.

Example 5

Figure 13A:
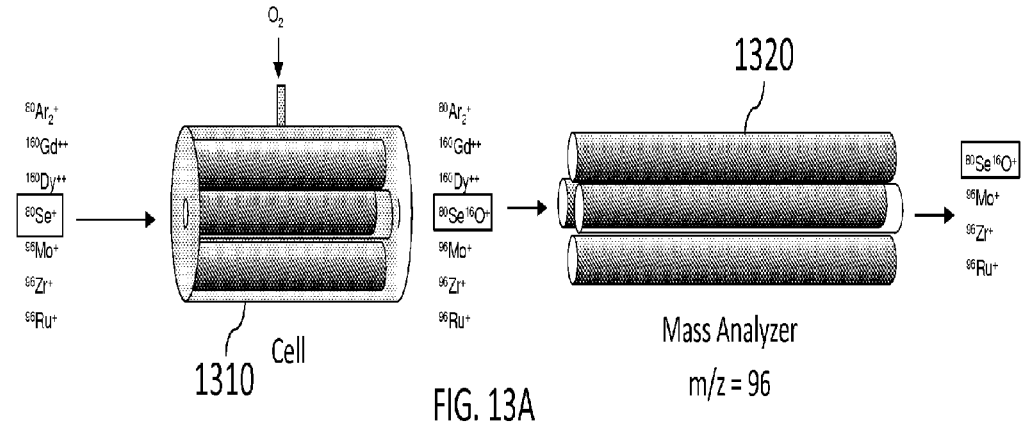
Figure 13B:
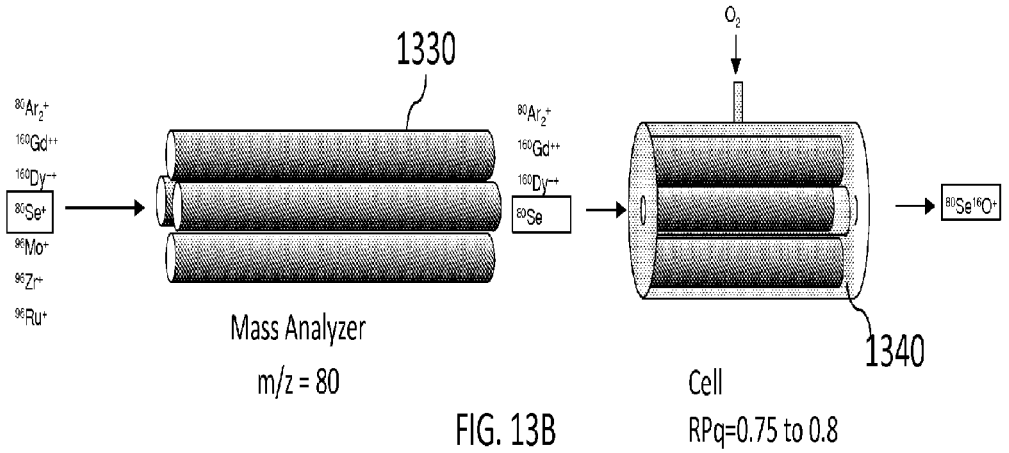

Ion simulations were performed to compare the results of a conventional system (FIG. 13A) where the cell 1310 is upstream of a mass analyzer 1320, and a new system (FIG. 13B) where the cell 1340 is downstream of the mass analyzer 1330. The simulation of selenium (m/z of 80) reaction products with oxygen was performed. The matrix introduced into the cell 1310 (FIG. 13A) includes $^{80}Ar_2^+$, $^{160}Gd^{++}$, $^{160}Dy^{++}$, $^{80}Se^+$, $^{96}Mo^+$, $^{96}Zr^+$ and $^{96}Ru^+$. The resulting reaction products with oxygen include $^{80}Ar_2^+$, $^{160}Gd^{++}$, $^{160}Dy^{++}$, $^{80}Se^{16}O^+$, $^{96}Mo^+$, $^{96}Zr^+$ and $^{96}Ru^+$. The reaction products are then provided to the mass analyzer 1320. Due to the matrix interferences present with m/z 96, four products will be selected ($^{80}Se^{16}O^+$, $^{96}Mo^+$, $^{96}Zr^+$ and $^{96}Ru^+$). The output from the mass analyzer 1320 includes species other than the desired selenium species. These additional species will also be provided to the detector (not shown), which will result in inaccurate measurements.

When the same simulation is performed with the mass analyzer 1330 upstream of the cell 1340 (FIG. 13B), ions with m/z of 80 can be first selected from the matrix to provide $^{80}Ar_2^+$, $^{160}Gd^{++}$, $^{160}Dy^{++}$, $^{80}Se$. These four species are then provided to the reaction cell 1340. Oxygen reacts with the selenium ions and permits their passage in the form of $^{80}Se^{16}O^+$, and the argon, gadolinium and dysprosium species are removed from the sample stream provided to the cell 1340. The output of the cell 1340 comprises only the selenium ions, which can be provided to a detector for detection.

Example 6

Figure 14A:
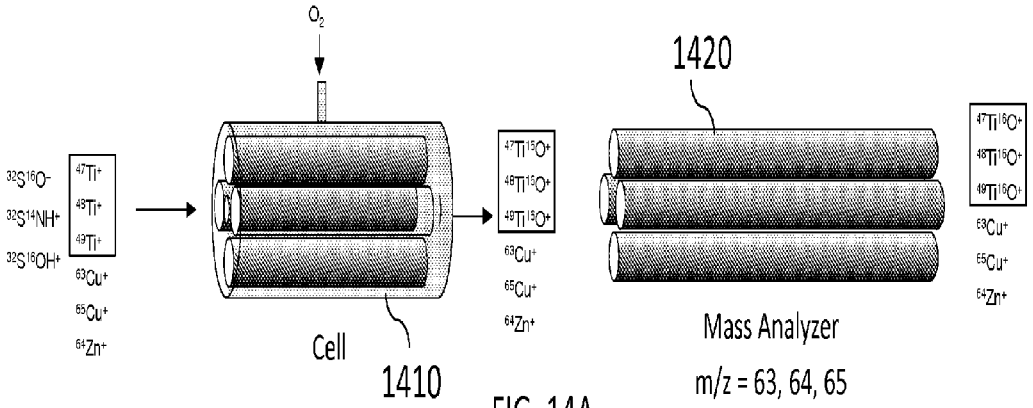
Figure 14B:
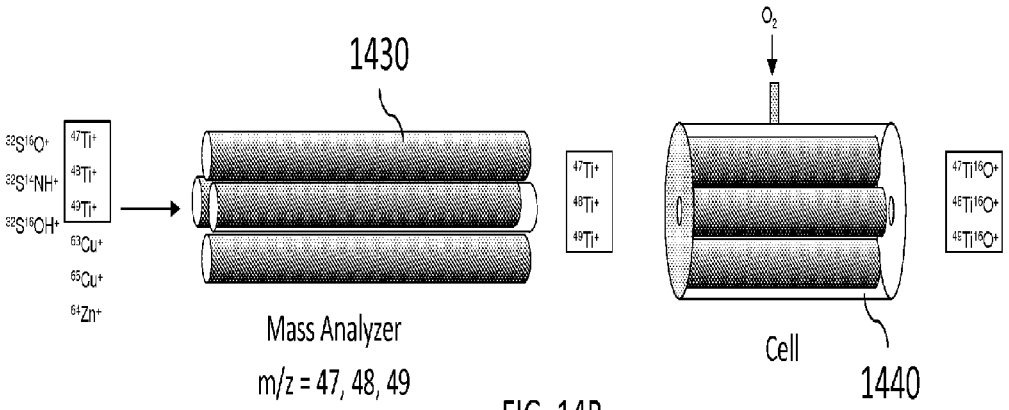

Ion simulations were performed to compare the results of a conventional system (FIG. 14A) where the cell 1410 is upstream of a mass analyzer 1420, and a new system (FIG. 14B) where the cell 1440 is downstream of the mass analyzer 1430. The simulation of titanium isotopes (m/z of 47, 48 and 49) reaction products with oxygen was performed. The matrix introduced into the cell 1410 (FIG. 14A) includes $^{32}S^{16}O^+$, $^{32}S^{14}NH^+$, $^{32}S^{16}OH^+$, $^{47}Ti^+$, $^{48}Ti^+$, $^{49}Ti^+$, $^{63}Cu^+$, $^{65}Cu^+$ and $^{64}Zn^+$. The resulting reaction products with oxygen include $^{47}Ti^{16}O^+$, $^{48}Ti^{16}O^+$, $^{49}Ti^{16}O^+$, $^{63}Cu^+$, $^{65}Cu^+$ and $^{64}Zn^+$. The reaction products are then provided to the mass analyzer 1420. Due to the matrix interferences present with m/z 63, 64 and 65, all six species from the cell 1410 will be selected by the mass analyzer 1420. The output from the mass analyzer 1420 includes species other than the desired titanium isotope species. These additional species will also be provided to the detector (not shown), which will result in inaccurate measurements.

Figure 15A:
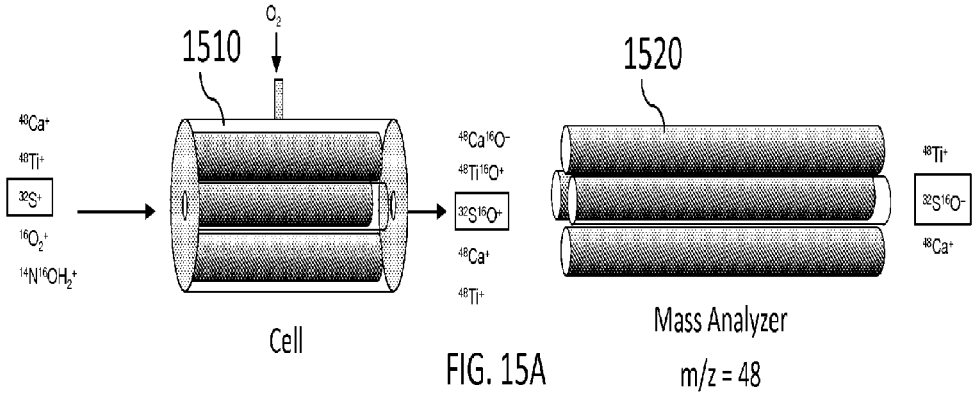
Figure 15B:
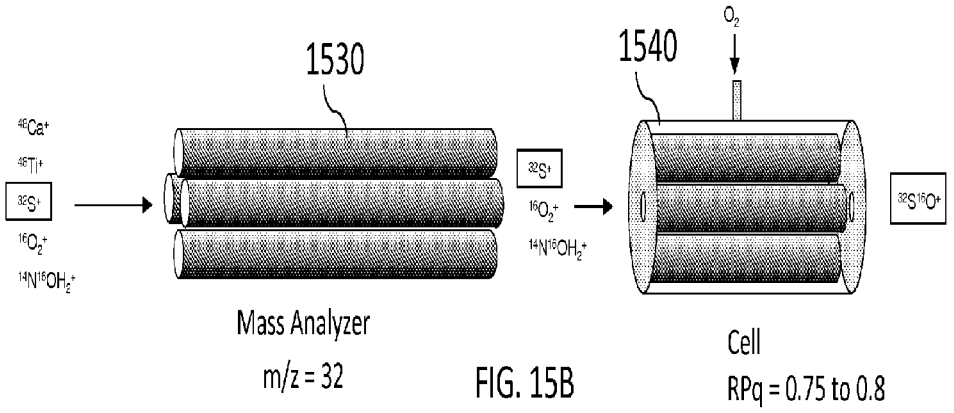

When the same simulation is performed with the mass analyzer 1430 upstream of the cell 1440 (FIG. 15B), ions with m/z of 47, 48 and 49 can be first selected from the matrix to provide $^{47}Ti^+$, $^{48}Ti^+$ and $^{49}Ti^+$. These three species are then provided to the reaction cell 1440. Oxygen reacts with the isotopes and permits their passage in the form of $^{47}Ti^{16}O^+$, $^{48}Ti^{16}O^+$, $^{49}Ti^{16}O^+$. By placing the mass analyzer 1430 upstream of the cell 1440, all interfering species in the matrix can be removed from the sample. The output of the cell 1440 comprises only the titanium ion reaction products, which can be provided to a detector for detection.

Example 7

Ion simulations were performed to compare the results of a conventional system (FIG. 15A) where the cell 1510 is upstream of a mass analyzer 1520, and a new system (FIG. 15B) where the cell 1540 is downstream of the mass analyzer 1530. The simulation of sulfur (m/z of 32) reaction products with oxygen was performed. The matrix introduced into the cell 1510 (FIG. 15A) includes $^{48}Ca^+$, $^{48}Ti^+$, $^{32}S^+$, $^{16}O_2^+$ and $^{14}N^{16}OH_2^+$. The resulting reaction products with oxygen include $^{48}Ca^{16}O+$, $^{48}Ti^{16}O+$, $^{32}S^{16}O+$, $^{48}Ca^+$, and $^{48}Ti^+$. The reaction products are then provided to the mass analyzer 1520 to select species with a m/z of 48. Due to the matrix interferences present with, three species from the cell ($^{32}S^{16}O+$, $^{48}Ca^+$, and $^{48}Ti^+$) will be selected by the mass analyzer 1520. The output from the mass analyzer 1520 includes species other than the desired sulfur reaction products. These additional species will also be provided to the detector (not shown), which will result in inaccurate measurements.

When the same simulation is performed with the mass analyzer 1530 upstream of the cell 1540 (FIG. 15B), ions with m/z of 32 can be first selected from the matrix to provide $^{32}S^+$, $^{16}O_2^+$ and $^{14}N^{16}OH_2^+$. These three species are then provided to the reaction cell 1540. Oxygen reacts with the sulfur and the other two species are removed. The resulting $^{32}S^{16}O^+$ exits the cell 1540 and all interfering species in the matrix have been removed from the sample. The output of the cell 1540 comprises only the sulfur reaction product, which can be provided to a detector for detection.

When introducing elements of the aspects, embodiments and examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

The invention claimed is:

1. A method comprising:

selecting native ions comprising a single mass-to-charge ratio from an ion beam comprising a plurality of ions with different mass-to-charge ratios; and providing the selected, native ions to a downstream cell.

2. The method of claim 1, further comprising selecting the native ions using a mass analyzer.

3. The method of claim 1, further comprising configuring the cell to remove interfering ions in the native ions.

4. The method of claim 3, further comprising configuring the cell as a reaction cell.

5. The method of claim 3, further comprising configuring the cell as a collision cell.

6. The method of claim 3, further comprising configuring the cell to operate in both a collision mode and a reaction mode.

7. The method of claim 1, further comprising configuring the system with an additional cell upstream of the downstream cell.

8. The method of claim 1, further comprising configuring the system with an ion source, a mass analyzer and a detector, in which the ion source is upstream of the mass analyzer, the mass analyzer is upstream of the downstream cell and between the ion source and the downstream cell and in which the detector is downstream of the downstream cell.

9. The method of claim 1, further comprising reacting the selected, native ions with a reactant gas effective to react with interfering ions in the selected, native ions.

10. The method of claim 1, further comprising colliding the selected, native ions with a collision gas effective to alter interfering ions in the selected, native ions.

11. The method of claim 2, wherein the mass analyzer upstream of the downstream cell is the only mass analyzer used to select the native ions.

* * * * *